US011185153B2

(12) United States Patent
McLaughlin

(10) Patent No.: US 11,185,153 B2
(45) Date of Patent: Nov. 30, 2021

(54) APPARATUS FOR THE INTERDICTION OF PERIODONTAL DISEASE

(71) Applicant: Lasertrolley LLC, Los Angeles, CA (US)

(72) Inventor: Thomas McLaughlin, Los Angeles, CA (US)

( * ) Notice: Subject to any disclaimer, the term of this patent is extended or adjusted under 35 U.S.C. 154(b) by 0 days.

(21) Appl. No.: 16/930,989

(22) Filed: Jul. 16, 2020

(65) Prior Publication Data

US 2021/0321756 A1 Oct. 21, 2021

Related U.S. Application Data

(60) Provisional application No. 63/013,249, filed on Apr. 21, 2020.

(51) Int. Cl.

| | |
|---|---|
| ***A46B 9/04*** | (2006.01) |
| ***A46B 9/02*** | (2006.01) |
| ***A46B 5/00*** | (2006.01) |
| ***A46B 11/00*** | (2006.01) |

(52) U.S. Cl.

CPC ..... *A46B 9/045* (2013.01); *A46B 5/0062* (2013.01); *A46B 9/025* (2013.01); *A46B 9/026* (2013.01); *A46B 9/028* (2013.01); *A46B 11/0062* (2013.01); *A46B 11/0065* (2013.01); *A46B 11/0068* (2013.01); *A46B 11/0072* (2013.01); *A46B 2200/108* (2013.01)

(58) Field of Classification Search

CPC ..... A46B 9/045; A46B 9/028; A46B 9/026; A46B 9/025; A46B 5/0012; A46B 5/0662; A46B 5/02; A46B 5/0025; A46B 9/06; A46B 7/06; A46B 7/08; A46B 11/0062; A46B 11/0065

See application file for complete search history.

(56) References Cited

U.S. PATENT DOCUMENTS

| | | | | |
|---|---|---|---|---|
| 4,428,091 A * | 1/1984 | Janssen | A46B 5/0062 | 15/167.2 |
| 6,119,296 A * | 9/2000 | Noe | A46B 11/0003 | 15/104.94 |
| 6,602,013 B2 * | 8/2003 | Clark | A46B 9/026 | 401/282 |
| 2006/0085933 A1 * | 4/2006 | Meyman | A46B 7/06 | 15/167.2 |

* cited by examiner

*Primary Examiner* — Shay Karls

(57) ABSTRACT

An apparatus for the interdiction of periodontal disease comprising a device the size of a US quarter coin capable of being chewed by a user, and which is configured with finger protrusions having fabricated blade ends capable of removing plaque from the teeth surface and disrupting plaque accumulated in the gingivae pockets of the teeth. The device of the apparatus is additionally configured with re-fillable inserts holding hygienic formulations to limit bacterial growth and flush plaque debris out of the gingivae pockets of the teeth. Some embodiments of the device of the apparatus are wholly digestible. The device of the apparatus is portable and comes in a plurality of embodiments in different shapes, all having the basic functionality of, self-treating periodontal disease.

18 Claims, 33 Drawing Sheets

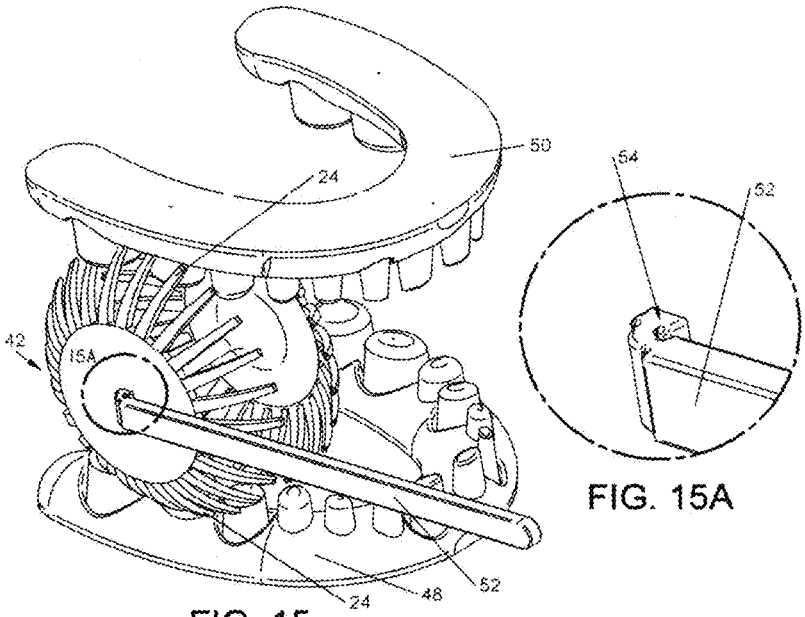
FIG. 15
FIG. 15A
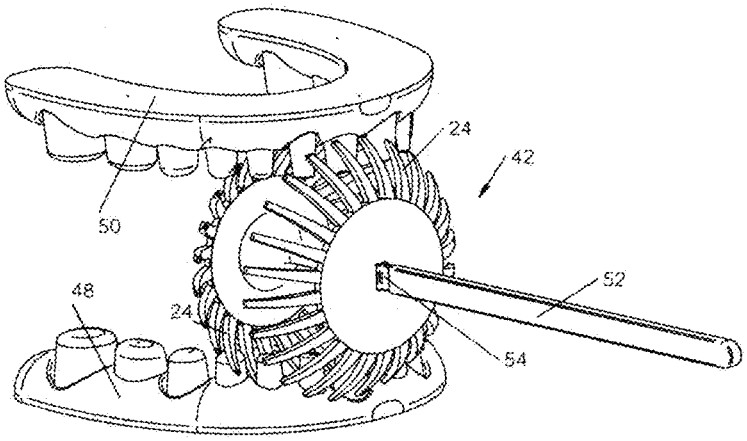
FIG. 16

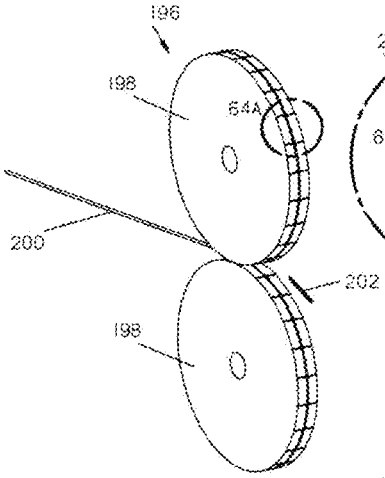
FIG. 64
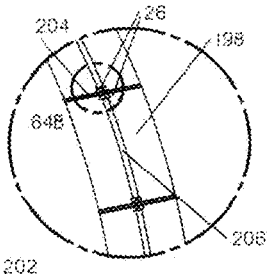
FIG. 64A
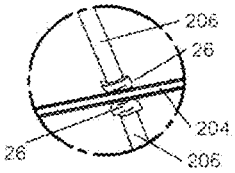
FIG. 64B
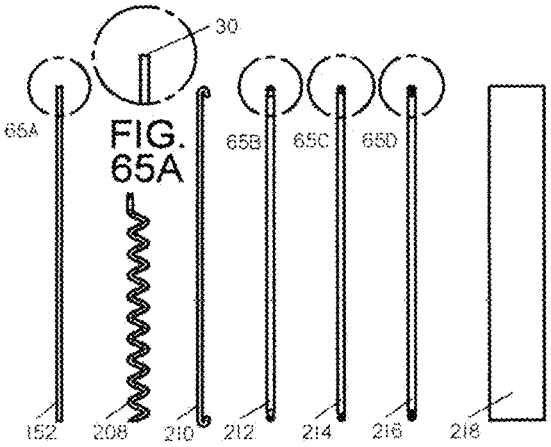
FIG. 65A
FIG. 65
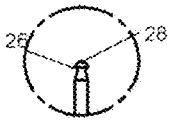
FIG. 65B
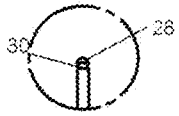
FIG. 65C
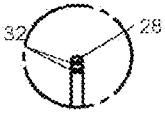
FIG. 65D

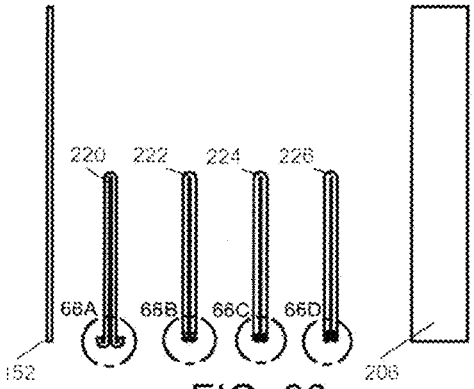
FIG. 66
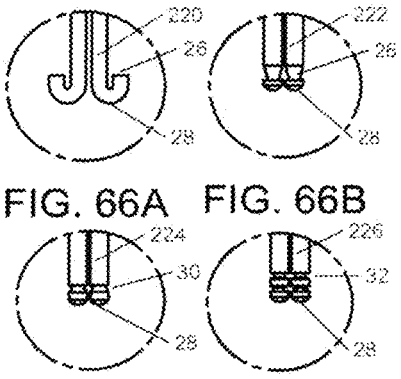
FIG. 66A FIG. 66B
FIG. 66C FIG. 66D
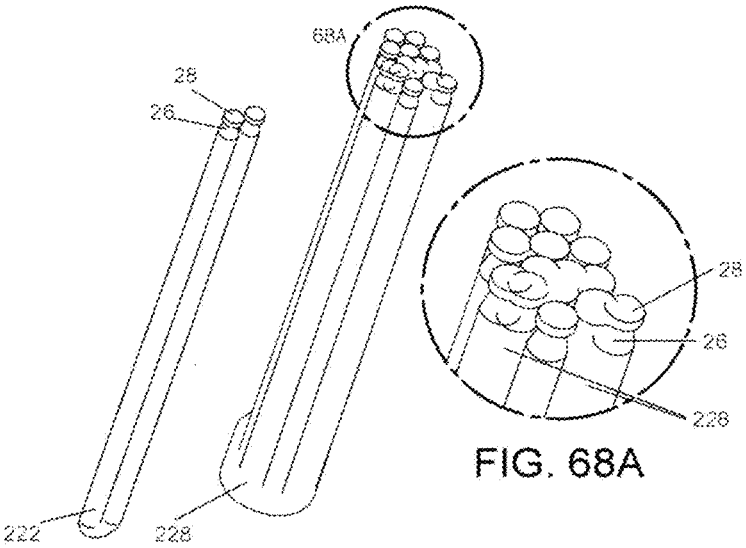
FIG. 68A
FIG. 67 FIG. 68

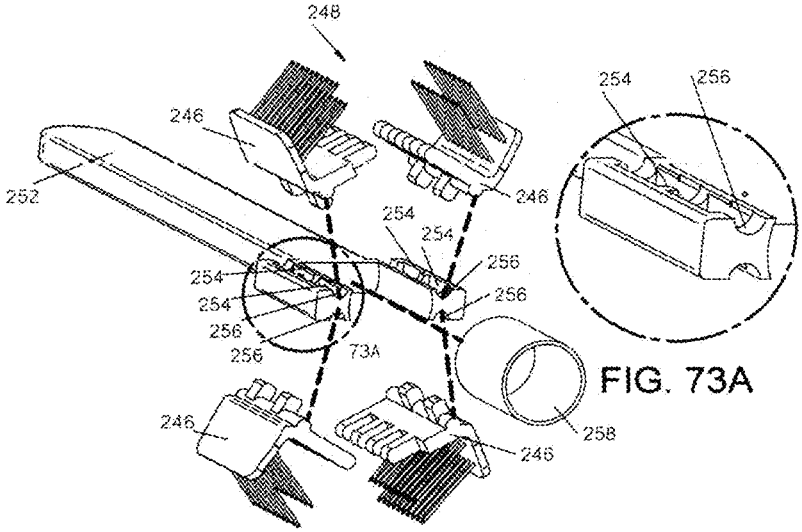
FIG. 73A
FIG. 73
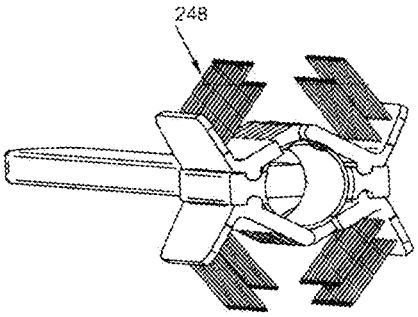
FIG. 74

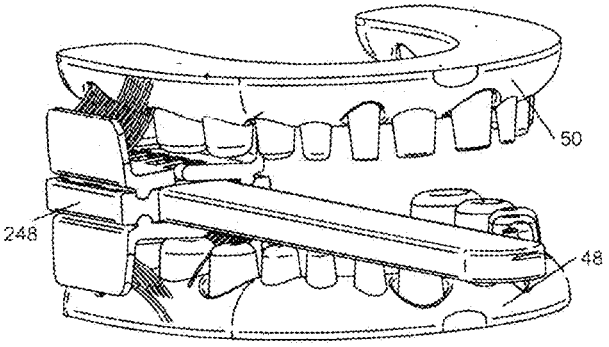
FIG. 75
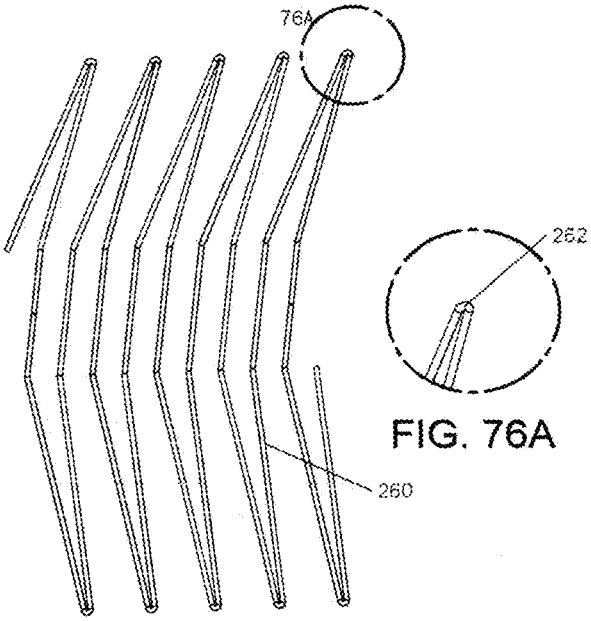
FIG. 76A
FIG. 76

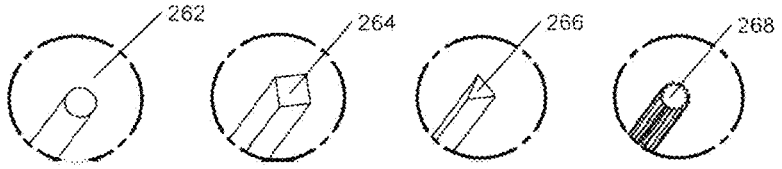
FIG. 77A FIG. 77B FIG. 77C FIG. 77D
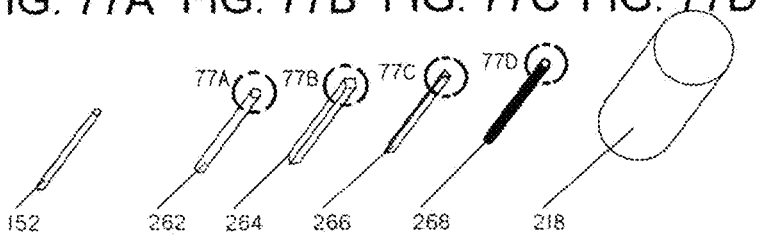
FIG. 77
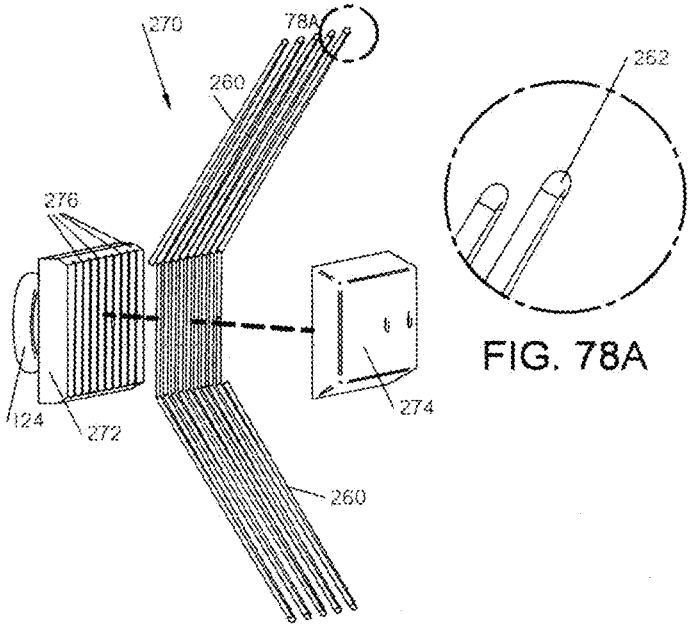
FIG. 78A
FIG. 78

APPARATUS FOR THE INTERDICTION OF PERIODONTAL DISEASE

CROSS REFERENCE TO RELATED APPLICATION

This application claims priority to U.S. Provisional Patent Application Titled: System, Method, And Apparatus For The Interdiction Of Periodontal Disease, Ser. No. 62/980,939, filed on Feb. 24, 2020, which is incorporated herein, in its entirety.

FIELD OF THE INVENTION

The present invention relates generally to methods and devices used to quell the progression of periodontal disease. More particularly, the invention relates to a portable apparatus and method for self-treatment to interdict the progression of periodontal disease without the assistance of a dentist or dental hygienist.

BACKGROUND OF THE INVENTION

Periodontal disease is an infection of the tissues called gingivae surrounding a tooth. In the early stages of the disease called gingivitis, a sticky film initially formed by bacteria on the tooth surface, progressively leads to the formation of a substance referred to as, plaque, resulting from the buildup of the bacteria combined with food debris on the tooth and surrounding tissue, that later hardens into a product called tartar around the tooth. The onset of gingivitis is characterized by swollen and bleeding gums which is the body's natural response to the presence of harmful bacteria around the tooth.

As gingivitis festers, gingivae pockets are formed between the gum and the tooth which become deeper due to the ongoing bacterial, acid producing activity, eroding the gingivae and even the tooth bone, while causing inflammation of the gum. This may be particularly true on hard-to-get-at tooth surfaces abutting the gingivae. Over time, the plaque formed will accumulate and calcify into tartar which cannot be readily removed by brushing. In addition, the minerals in saliva hasten the hardening of the plaque biofilm in as little as 24 hours. Access to the problem tooth areas transitioning from plaque to tartar could be further hampered by braces, dry mouth, crowded teeth, smoking, and aging. Once dental plaque hardens into tartar and gets calcified, removing the tartar generally requires aggressive, remedial treatments to remove the tartar, by a dentist or dental hygienist.

In the advanced stages of periodontal disease, called periodontitis, the gums of the tooth pull away, forming deeper gingivae pockets in which the bacteria fester and the gum tissue is destroyed, resulting in bone loss and causing the teeth to loosen and even fall out. Chronic periodontitis, the most advanced form of the disease, progresses relatively slowly in most people and may be typically more evident in adulthood.

Studies have shown that periodontal disease can start as early as after a child's adult teeth erupt if proper measures are not taken to quell the onset of the disease. Even with brushing and flossing twice a day and after each meal, it is impossible to effectively remove all plaque buildup around the teeth which fosters gingival bacterial colonization leading to gingivitis and eventually to periodontitis. Brushing and flossing may effectively clean tooth anatomy above the gum line but not where the periodontal disease actually lurks within the gingival pockets. A toothbrush, whether it be manual or electric, primarily uses sweeping, swirling or back and forth motions which may clean flatter exposed tooth surfaces, but the toothbrush bristles cannot fully enter gingivae pockets to clean plaque, particularly those pockets deepened by the progression of periodontal disease. Flossing too, by its very nature, may be effective in clearing plaque between teeth but cannot clear plaque within gingival pockets.

Although periodic visits to a dentist and/or hygienist may clean up most plaque and tartar deposits, during the intervening periods between the annual or semi-annual dental visits, bacteria make inroads within the gingival pockets surrounding the base of affected teeth, causing the onset and progression of periodontal disease. Therefore, the typical routine of dental and/or hygienist visits may be inadequate to slow, or even quell the progression of periodontal disease.

Typically, dentists and hygienists use devices such as plaque scrapers to remove plaque and tartar from the teeth. The safe use of plaque scrapers and other dental tools used by dentists and dental hygienists for the removal of plaque and tartar from teeth requires specialized training which the dentists and hygienists undergo and the improper use of these plaque scrapers at home can cause gum recession as well as infections from damage to delicate gum tissue, cheeks, the tongue, or other soft tissues.

There is a need in the art for a means to quell and/or treat the progression of periodontal disease without frequent visits to the dentist or dental hygienist. The present invention provides that means in the form of an apparatus and method for self-treatment of periodontal disease at home or when travelling.

SUMMARY OF THE INVENTION

The apparatus of the present invention is a simple, inexpensive, and effective device for the treatment of periodontal disease that can be used by virtually anyone, anywhere and at any time. The apparatus of the invention reduces periodontal infections and the progression of periodontal disease by clearing dental plaque in and around gingivae pockets formed between the gum and the tooth as well as disseminating proprietary formulations into the gingivae pockets to clean and disinfect the pockets to maintain gum and gingivae tissue health.

It is an object of the present invention to provide a portable, apparatus that can be used for self-treating periodontal disease without frequent visits to the dentist or dental hygienist to remove plaque and tartar that accumulate on and around teeth to quell the progression of periodontal disease.

It is an object of the present invention to provide an apparatus for the treatment of periodontal disease which requires only the action of chewing on the apparatus when placed in a user's mouth which results in the destruction and clearing of dental plaque buildup in and around the gingivae pockets of the teeth.

It is yet another object of the present invention to provide an apparatus for self-treatment of periodontal disease that besides clearing the plaque developed in and around the gingivae pockets, also disseminates hygienic and salivation inducing formulae that helps to limit bacterial growth in the gingivae pockets and additionally flushes out the plaque debris from the pockets.

Yet another object of the present invention is to provide an apparatus for the self-treatment of periodontal disease that is not cumbersome to use, and the act of chewing on the apparatus provides an enjoyable experience while at the same time treating the periodontal disease. Since studies have shown that periodontal disease starts at a very young age. It could be beneficial for younger people to experience the use of the apparatus as fun and pleasurable.

In use, the apparatus of the invention is placed into a user's mouth between the teeth in the upper and lower jaws. Once positioned, the user commences chewing onto the apparatus. The chewing motion causes a plurality of finger-like protrusions to slide snugly against smooth tooth surfaces and be repeatedly repositioned towards, into, and away from the gingivae pockets. The chewing movement causes the finger protrusions to engage and progressively diminish plaque deposits on tooth surfaces. As the finger protrusions progress and abut the deepest aspect of the user's gingival pockets, they flex, or are sprung back, limiting their further progression, thus preventing damage to the gingivae's soft tissue. The intrusion of the finger protrusions into the gingival pockets may also disturb bacterial colonization and open up closed gingival pocket areas for treatment. Chewing on the apparatus also disseminates hygienic and salivation-inducing formulae to help limit bacterial growth and flush plaque debris out of the gingivae pockets.

In the exemplary embodiment of the present invention, fabrication and use of the apparatus may include commercially available hardware, materials, formulations and combinations thereof, such as:

- Soft, pliable and durable rubber-like thermoplastic elastomers;
- Silicone rubber or synthetic rubber formulations;
- Synthetic materials, such as nylon, melt-processed into fibers, films, or shapes;
- Nylon, polyester bamboo and/or natural fibers and bristles, such as boar's hair;
- Rigid, flexible and/or spring-like plastics and other synthetics;
- Metals and other rigid materials;
- Chewable and digestible dissolvable elements and components, and
- Hygienic and other types of formulae in a variety of forms, such as liquid, gels, or a combination of products of various compositions.

Embodiments of the apparatus of the invention may be produced in a wide variety of shapes, such as round, oval, square and other possible shapes, and may be of different sizes, such as small, medium and large.

Embodiments of the apparatus of the invention may have a range of stiffness factors, such as soft, medium and firm. Although shape, size and rigidity factors are not all specifically shown in the drawings, such variations are implicit in the design of the apparatus.

Embodiments of the apparatus of the invention may distribute a wide variety of formulae by various means into the user's oral cavity to facilitate periodontal disease reduction and plaque debris removal.

BRIEF DESCRIPTION OF THE DRAWINGS

The apparatus of the present invention will be more readily understood through the embodiments illustrated in the following figures in conjunction with their detailed descriptions that follow.

FIG. 15 depicts the FIG. 8 embodiment with an attached arm positioned between teeth in the upper and lower jaws.

FIG. 15A depicts an enlarged partial view of a flexible joint on the arm.

FIG. 16 depicts the FIG. 8 embodiment with the attached arm positioned between the front teeth in the upper and lower jaws.

FIG. 64 depicts a simplistic illustration of an opposing two-wheel bristle shaper and cutter aspects of a machine designed to produce fabricated bristles.

FIG. 64A depicts an enlarged partial view of die cutouts on the FIG. 64 machine's shaper and cutter wheel, for forming bristles and their ends.

FIG. 64B shows an enlarged partial view of FIG. 64A further expanding the view of the die cutouts on the shaper and cutter wheel.

FIG. 65 depicts fabricated bristles compared in size to a toothbrush-width bristle (first upright image) and a length of pencil lead (last upright image).

FIG. 65A depicts an enlarged partial view of the end of a toothbrush bristle.

FIG. 65B, FIG. 65C and FIG. 65D depict enlarged partial views of fabricated bristle ends.

FIG. 66 depicts fabricated bristles from FIG. 65 folded over compared in size to a toothbrush-width bristle (first upright image) and a length of pencil lead (last upright image).

FIG. 66A, FIG. 66B, FIG. 66C and FIG. 66D depict enlarged partial views of the ends of folded fabricated bristles.

FIG. 67 depicts a view of the folded FIG. 66B fabricated bristle.

FIG. 68 depicts a grouping of FIG. 66B fabricated bristles.

FIG. 68A depicts an enlarged view of ends of a FIG. 68 fabricated bristle grouping.

FIG. 73 depicts an exploded perspective view of an embodiment of the apparatus of the invention with four FIG. 72A "L" shaped parts fully populated with fabricated bristles, a flat arm and a round tube.

FIG. 73A depicts an enlarged partial view of the cutouts in the FIG. 73 flat arm.

FIG. 74 depicts the FIG. 73 embodiment assembled.

FIG. 75 depicts the FIG. 73 embodiment positioned between a partially closed set of teeth in the upper and lower jaws.

FIG. 76 depicts a wire-like extruded protrusion part.

FIG. 76A depicts a partial enlarged view of a bend in the FIG. 76 protrusion end.

FIG. 77 depicts a plurality of lengths of extrusion shapes compared in size to a toothbrush-width bristle (first slanted image) and a length of pencil lead (last slanted image).

FIG. 77A depicts partial enlarged view of round extrusion.

FIG. 77B depicts a partial enlarged view of square extrusion.

FIG. 77C depicts a partial enlarged view of triangular extrusion.

FIG. 77D depicts a partial enlarged view of multi-edged extrusion.

FIG. 78 depicts a formed section of an extrusion positioned to be installed between two parts with a dashed assembly line.

FIG. 78A depicts an enlarged partial view of the FIG. 78A extrusion's bent ends.

DETAILED DESCRIPTION OF THE INVENTION

Figure 1:
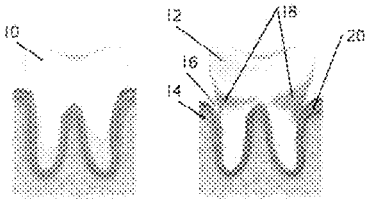
FIG. 1 depicts a human molar with healthy gingivae beside a molar with periodontitis-affected gingivae.

The present invention is an apparatus and method for the interdiction of periodontal disease by self-treatment of the disease using the apparatus and the prescribed method, in the confines of one's home or when travelling, without the assistance of a dentist or dental hygienist.

A plurality of non-limiting embodiments of the present disclosure will now be described to provide an overall understanding of the principles of the structure, function, and use of the apparatus disclosed herein. One or more examples of these non-limiting embodiments are illustrated in the accompanying drawings. Those of ordinary skill in the art will understand that the embodiments and their use specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout this specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Described herein are examples of embodiments of the apparatus of the invention and methods for their use. The embodiments discussed herein are examples only and are provided to assist in the explanation of the devices and methods described herein. None of the features or components shown in the drawings or discussed below should be taken as mandatory for any specific implementation of any of these devices or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible.

Example embodiments described herein can readily assist in the removal of oral plaque within the gingivae pockets. For example, unlike the mediocre removal of plaque through the traditional use of a toothbrush and/or floss, the apparatus of the present invention specifically addresses the removal of plaque from the gingivae pockets where periodontal disease festers. Additionally, or alternatively, the apparatus of the invention provides the means to dispense formulations that aid in the reduction of the disease and the removal of dislodged plaque debris from the gingivae pockets.

Referring now to FIG. 1 which provides a visual comparison between two human tooth molars, a healthy molar 10 on the left side of the figure and a molar 12 on the right side of the figure that has periodontitis-affected gingivae. The gum area affected by periodontitis on molar 12 shows typical anomalies such as a reduction in bone level 14, a deepened gingivae pocket 16, plaque 18 formed in and near the gingivae pocket 16 and gum inflammation 20. The overall functionality of the apparatus of the present invention broadly depicted by the embodiments provide a means to mitigate the long-term encroachment of periodontal disease by reducing plaque 18 in gingivae pocket 16.

Figure 2:
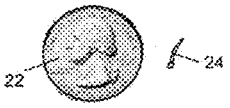
FIG. 2 depicts a size comparison between a US quarter and the length of a fabricated finger protrusion.

In the exemplary embodiments of the apparatus of the present invention, the quintessential structure that assists in the cleaning of plaque from the tooth surface and from within gingivae pockets is a fabricated protrusion referred to as the "finger." FIG. 2 shows the relative size and length of a finger 24 protrusion of the apparatus of the invention compared to a US Quarter 22 to illustrate the diminutive size of the finger 24 protrusion that accomplishes the task of cleaning the plaque from the tooth surface and from the gingivae pockets. The small size of the finger 24 protrusions allows their access to the myriad small spaces and crevices within the oral anatomies to accomplish the task of cleaning the plaque 18 accumulated in the gingivae pockets 16.

The finger 24 protrusions may be fabricated from a variety of materials that possess flexible and spring-like qualities. The finger 24 protrusions may be tubular, or solid, have varying lengths and sizes, and fabricated in a plurality of shapes, such as, round, oval, triangular, square and the like, and may be tapered, straight, curved, bent, folded, coiled or have other profiles, standing individually, or grouped in clusters.

Given the diversity in the size and dimensions of individual oral cavities, the finger 24 protrusions may vary in design and structure within embodiments. For example, the finger 24 protrusions may be manufactured having longer or shorter lengths within embodiments of the apparatus to accommodate individual user's needs as for example a child's gingival profile being closer to biting surfaces than a senior with a receding gum line.

Figures 3, 4, 5:
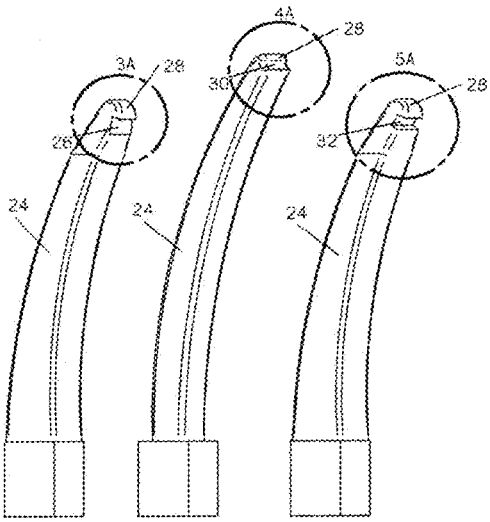
FIG. 3, FIG. 4 and FIG. 5 depict sectional lengths of finger protrusions with fabricated ends designed to cut into oral plaque deposits.
Figure 3A:
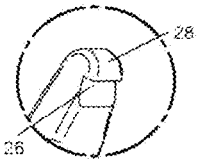
FIG. 3A, FIG. 4A and FIG. 5A depict enlarged partial views of the fabricated ends of the finger protrusions showing rounded and blade-like end profiles for the protrusions.
Figure 4A:
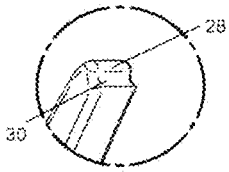
Figure 5A:
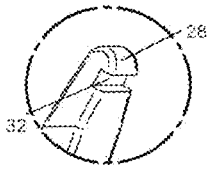

FIG. 3, FIG. 4 and FIG. 5 show three fabricated finger 24 protrusions with their leading edges rounded, herein named a "Bullnose" 28 profile. The Bullnose 28, is also shown in partially enlarged FIG. 3A, FIG. 4A and FIG. 5A with FIG. 4A showing a blunted profile or bumper end for finger 24 that serves to protect gingival tissues from injury as the finger 24 protrusion end comes in contact with potentially softer tissue. The other feature of the finger 24 protrusions called "blades" are positioned slightly away from Bullnose 28 at the far leading end of the finger 24 protrusions. FIG. 3 and FIG. 3A show a blade profile, herein named a Pull Blade" 26 which is configured to be pulled into and through plaque 18 deposits, akin to plaque 18 being cleared by an away-from-the-gums directional motion of a dentist or hygienist using a scaler. FIG. 4 and in a partially enlarged view FIG. 4A show a blade profile, herein named a "Push-Blade" 30. The Push-Blade 30 is configured to slice into plaque 18 deposits, the action being akin to a wood plane slicing into wood. FIG. 5 and the partially enlarged view FIG. 5A show a blade profile, herein named a "Push-Pull Blade" 32. The Push-Pull Blade 32 is configured to slice into plaque 18 deposits by being pushed or pulled to reduce their mass, much like the teeth of saws. The three types of blades illustrated through these figures may also be placed repeatedly along the length of the finger 24 protrusions to increase the plaque 18 clearing capability of the finger 24 protrusions outside of the gingivae pockets 16. The blade of the finger 24 protrusions are also sufficiently edged and durable for repeated use to clear plaque 18. The finger 24 protrusions are sufficiently flexible to closely follow dental anatomy. Although there may be flexible materials that fill both the requirements of flexibility and edge durability, it may be a reasonable option to bring together two different materials in the design of the finger 24 protrusions, one sufficiently flexible and another to maintain a resilient edge.

Figure 6:
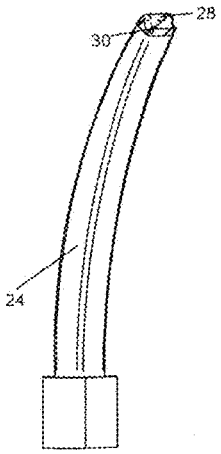
FIG. 6 depicts the FIG. 4 finger protrusion for comparison with the FIG. 7 finger protrusion with a disengaged tip.
Figure 7:
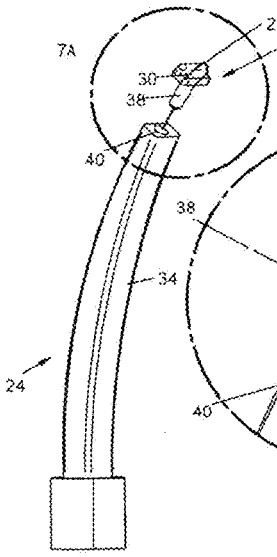
FIG. 7A is an exploded view of the FIG. 4 finger protrusion leading end, disengaged from the body of the finger protrusion.

FIG. 6 illustrates a finger 24 protrusion that appears to be the same as the finger 24 protrusion shown in FIG. 4 having a Bullnose 28 end and a Push-Blade 30 profile. But as shown in FIG. 7 the FIG. 6 finger 24 protrusion may be composed of two sections, namely a lower finger section 34 and an upper finger section 36. As shown in FIG. 7 the two sections are separated by a dashed insertion line. In this optional scenario, the lower finger section 34 can be made of a formable flexible material, such as plastic or nylon. The upper finger section 36 may be made of a durable material such as a metal or other rigid material. The upper finger section 36, as shown, has Bullnose 28 and Push-Blade 30 profiles and may be attached or molded together with the lower finger section 34 in various ways.

Figure 7A:
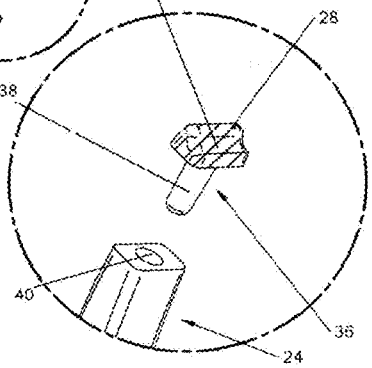

FIG. 7A shows a partial exploded view of the upper finger section 36. To assemble, the upper finger section 36's insertion stem 38 may be inserted into the lower finger section 34's insertion hole 40 and may be then bonded or glued in place resulting in a finger 24 protrusions composed of two materials as shown in FIG. 6 having the same exact shape as the finger 24 protrusions in FIG. 4. Not illustrated here, but related to FIG. 6, FIG. 7 and FIG. 7A, an alternative may be hard coating the ends of the thermoplastic elastomer finger 24 protrusions with a thin hardening substance to make the finger 24 protrusions more rigid and durable while allowing the bulk of the finger 24 structure to remain flexible. This alternative may retain the needed flexibility of the finger 24 protrusion for its intended use as springy appendage that conforms to the undulating teeth 48 and teeth 50 surfaces while providing edgier blades to help reduce plaque 18 in the gingivae pockets 16. Nylon or engineered plastic finger 24 protrusions may also benefit from better performing resins that resist abuse, retain their surface quality and provide significant improvements in rigidity without the added expense of hard coating. The better performing resins may be applied to the finger 24 protrusions as a whole as long as the flexibility needed can be retained. Relative to FIG. 7 and FIG. 7A, the upper finger sections 36 may be made of better performing resins, instead of a metal, to achieve the needed hardness to ensure blade edge hardness and durability.

Figure 8:
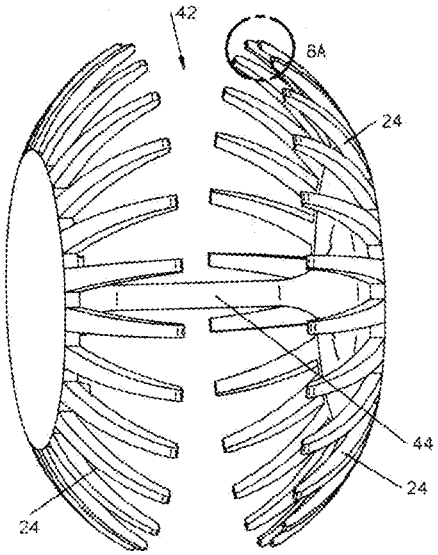
FIG. 8 is a perspective view of a one-piece round-shaped yo-yo like embodiment of the apparatus of the present invention.

FIG. 8 depicts a one-piece round-shaped yo-yo-like embodiment 42 of the apparatus of the present invention. The embodiment 42 is shown having a plurality of finger 24 protrusions on each of its two sides. The two halves of the yo-yo configuration are joined by a cross member 44. The embodiment 42 may be molded or cast of a rigid rubbery thermoplastic elastomer or other moldable material. Being fully moldable, the embodiment 42 may also be formed from a slow-dissolving digestible formulation that may be fully chewed and swallowed. The idea of the embodiment 42 being wholly digestible may apply to other embodiments presented and only be limited by the practical application of being digestible to other embodiment design factors. Setup and manufacturing would be inexpensive for the embodiment 42 since only one mold may be needed for molding or casting. No assembly would be needed. Given its yo-yo-like shape, the embodiment 42 may also be molded in duplicate halves. This may reduce the mold-making cost but there may be assembly, bonding and/or gluing costs involved to marry the two halves. The embodiment 42 may be simple to use and easy to carry. Given the embodiment 42's potentially low overall costs, it may be affordably priced to consumers and be an inexpensive means to augment oral-hygiene regimens.

Figure 8A:
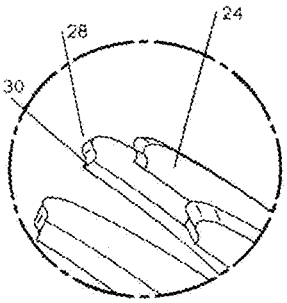
FIG. 8A is an enlarged partial view of the finger protrusion leading ends of the one-piece round-shaped yo-yo like embodiment of the apparatus shown in FIG. 8.

FIG. 8A is a partial enlarged view of the embodiment 42 finger 24 protrusion ends showing the Bull Nose 28 and Push-Blade 30 profiles. This blade design would reduce plaque 18 deposits by being pushed through the plaque 18 like a plane slicing a wooden surface.

Figure 9:
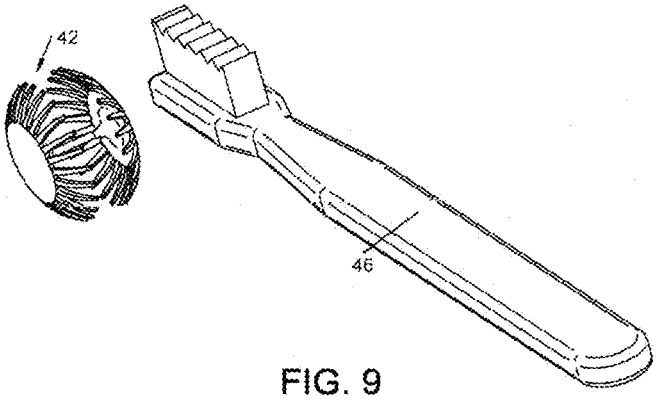
FIG. 9 shows a size comparison between a toothbrush and the FIG. 8 embodiment.

FIG. 9 illustrates a size comparison of the embodiment 42 with a typical toothbrush 46. The diameter of the entire embodiment 42 may be similar in size to that of the US Quarter 12 shown in FIG. 2.

Figure 10:
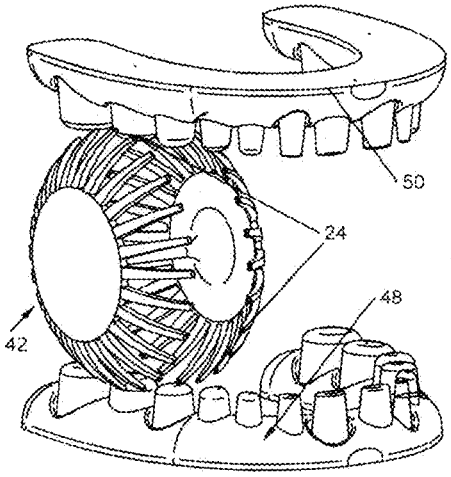
FIG. 10 illustrates the FIG. 8 embodiment between the teeth in the upper and lower jaws.
Figure 11:
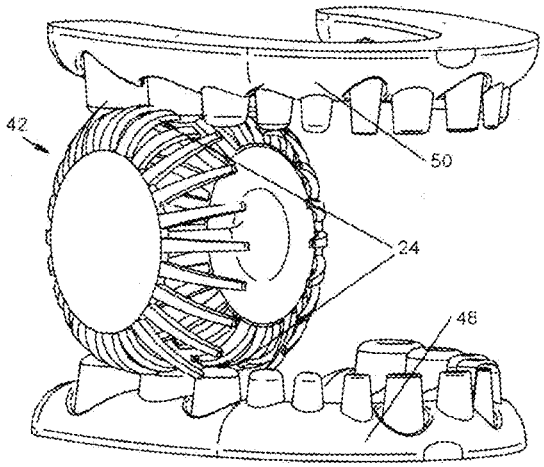
FIG. 11 depicts the FIG. 8 embodiment's finger protrusions being bent by the closing of the teeth onto the FIG. 8 embodiment.

FIG. 10 shows the embodiment 42 positioned for use between an upper set of teeth and a lower set of teeth, herein named teeth 48 and teeth 50, with its finger 24 protrusion ends near the biting surfaces. The embodiment 42 positioned between teeth 48 and teeth 50, as shown in FIG. 10 and FIG. 11 illustrates how the flexible finger 24 protrusions bend inwards, caused by the biting down or closing of the teeth 48 and teeth 50 onto the embodiment 42 finger 24 protrusion ends. It is to be noted that in all embodiments, and as shown for embodiment 42 the finger 24 protrusions are slanted inwards to have their ends interface with and be positioned against the surface of the teeth 48 and teeth 50. This results in the finger 24 protrusion ends being pressed into and against the teeth 48 and teeth 50 surfaces during use.

Figure 12:
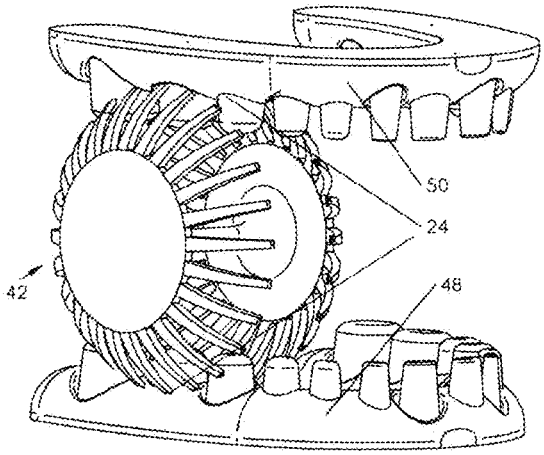
FIG. 12 depicts the FIG. 8 embodiment with the finger protrusions extended to the upper and lower gingivae.

FIG. 12 shows the embodiment 42 finger 24 protrusions re-positioned back to their original straighter orientation with their leading ends sprung against the outer surfaces of the teeth 48 and teeth 50 with the finger 24 protrusion ends positioned next to the gingivae pockets 16. It might take a few bite and release chewing sequences to prompt the finger 24 protrusions to align their far ends against the teeth 48 and teeth 50 surfaces much like how the inner heel of a shoe may become folded in upon entry of a foot. After a few ups and downs of the heel of the foot, the shoe may be prompted to regain its original shape around the heel. As the user's bite continues to close down the teeth, the leading ends of the finger 24 protrusions slide into position to enter the gingivae pockets 16.

Figure 13:
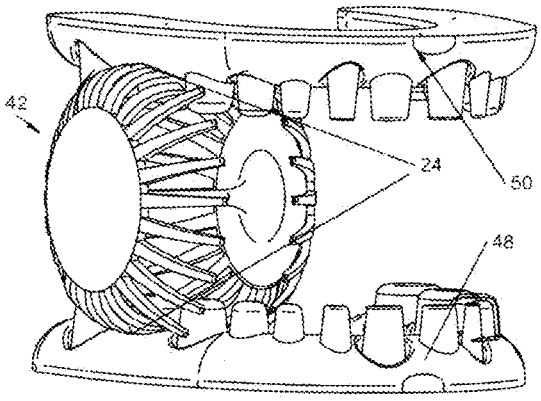
FIG. 13 depicts the FIG. 8 embodiment with the finger protrusions extending to and bent against the gingivae.

FIG. 13 shows that as the bite closes, the finger 24 protrusions extend to reach the depth of the gingivae pockets 16. At this point, the finger 24 protrusions abutting the depth of the gingivae pockets 16 begin to flex, thus avoiding injury to the soft gum tissue. The flexed finger 24 protrusions pressing against the gums also provide a spring-back response to the biting pressure. As the user's bite opens the finger 24 protrusions, they un-flex and straighten, allowing the embodiment 42 to reestablish its outstretched finger 24 protrusion position in readiness for the next chewing motion.

Figure 14:
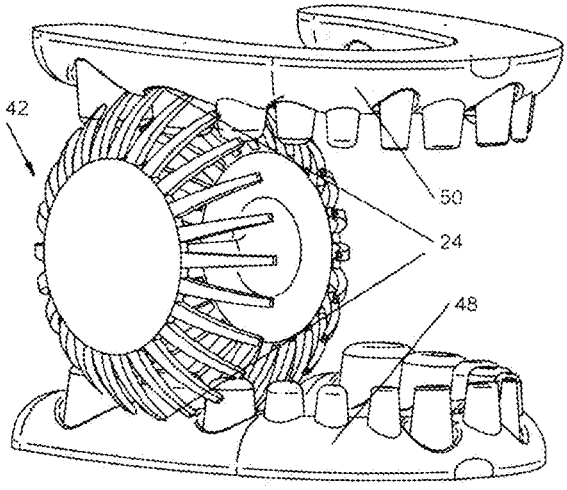
FIG. 14 depicts the upper and lower jaws being opened, and the FIG. 8 embodiment's finger protrusions straightened and re-extending to touch the gingivae.

FIG. 14 shows the embodiment 42 un-flexed and restored to its original position, as shown in FIG. 12 ready for the user to chew again and move the finger 24 protrusion ends into and out of the gingivae pockets 16.

FIG. 15 shows the embodiment 42, having an "Arm" 52 attachment. The Arm 52 attachment may provide users the means for easy insertion, movement and removal of the embodiment 42 before, during and after use. FIG. 15A shows a partial exploded detail of a flexible joint 54 for the Arm 52 so that the embodiment 42 could be easily repositioned to other parts of the mouth. Although the Arm 52 feature may be optional, it may be called for to alleviate individual hygiene concerns about putting the embodiment 42 in one's mouth without a means to move the embodiment 42 around. The Arm 52 may be of any length but long enough to extend from the embodiment 42 and out of the mouth between the lips, much like a lollypop stick. Given the embodiment 42's small size, the Arm 52 may also help to avoid concerns about swallowing the embodiment 42 when in use.

FIG. 16 shows the embodiment 42 straddled on the front teeth 48 and front teeth 50 with the flexible joint 54 of the Arm 52 in a straightened orientation.

Figure 17:
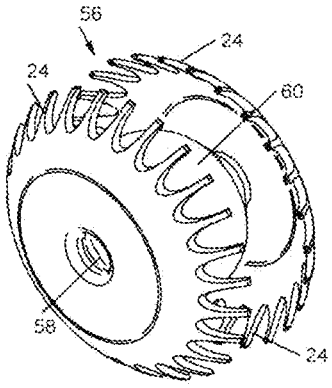
FIG. 17 depicts an embodiment of the apparatus of the invention with shortened finger protrusions and a bulbous center.
Figure 18:
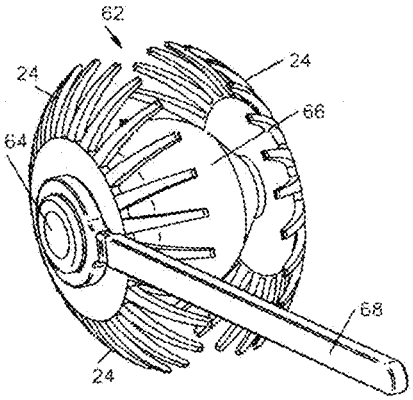
FIG. 18 depicts an embodiment of the apparatus of the invention with a bulbous center and a rotational arm.

FIG. 17 and FIG. 18 show two variants of the embodiment 42. In FIG. 17 embodiment 56 shown may be seen as similar in design to the embodiment 42 but with an air hole 58, a hollow bulbous center 60 and shorter fingers 24 protrusions. In FIG. 18 an embodiment 62 shown may be seen as similar in many ways to embodiment 42 but has a bulbous center 66 and a rotatable Arm 68 positioned on an arm guide 64. An air hole 58 part of embodiment 62 is not shown in FIG. 18 being obscured by the angle of view of embodiment 62. Given the added complexity of embodiments 56 and 62, it may be necessary for them to be molded or fabricated in two or more parts and then bonded or glued together. Embodiments 56 and 62 bring into play an additional factor. In use, the user bites down past the finger 24 protrusions and onto the bulbous center, 60 or 66, causing air to escape through the air hole 58 (not shown for embodiment 62). This allows the user to sufficiently compress the bulbous center 60 or 66 to allow the finger 24 protrusions to reach the gingivae pockets 16. The springiness of the bulbous center 60 and 66 also may increase the resistance to the user's bite, providing a need for increased biting pressure, resulting in a more realistic biting sensation. The added resistance may also increase the functionality of the finger 24 protrusions if they have Pull-Blades 26 or Push-Pull Blades 32. In this regard, as a user releases biting pressure, instead of the finger 24 protrusions flexing on the gum surface, the resiliency of the bulbous centers 60 and 66 accentuates the finger 24 protrusions to retreat. Since Pull-Blades 26 or Push-Pull Blades 32 operate or cut into plaque 18 as the finger 24 protrusions retreat, their ability to carve plaque 18 deposits may be improved.

Figure 19:
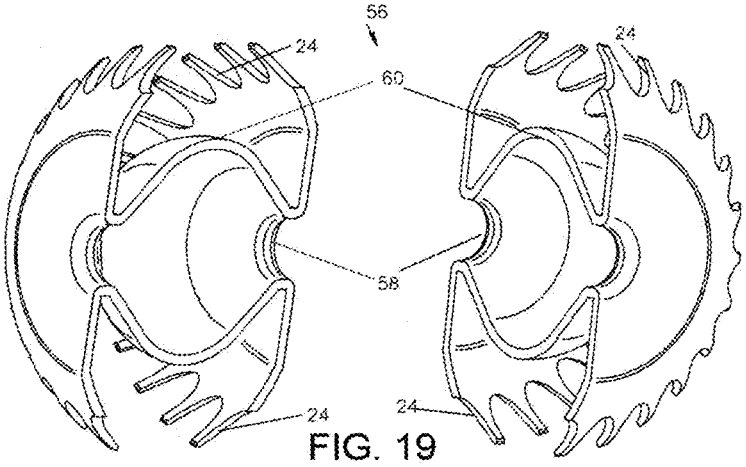
FIG. 19 depicts bisected halves of the FIG. 17 embodiment.

FIG. 19 shows the embodiment 56 in two halves illustrating its hollow make-up. Given the size and shape of the embodiments 56 and 62, spin casting, or rotational molding may be an option to produce them in one piece although their small size along with the finger 24 protrusions may present insurmountable technical and cost issues in mold design.

Figure 20:
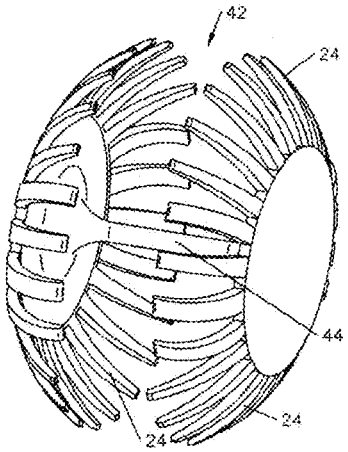
FIG. 20 depicts the FIG. 8 embodiment for comparison with the FIG. 21 figure.
Figure 21:
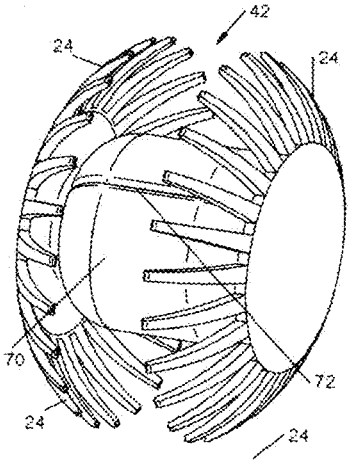
FIG. 21 depicts the FIG. 8 embodiment with an insert positioned at the center.
Figure 22:
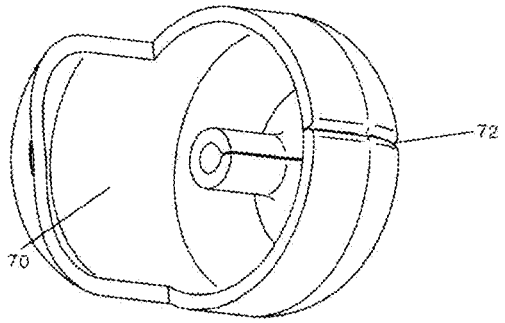
FIG. 22 depicts the FIG. 21 insert with a cut-away section exposing its hollow interior.

FIG. 20 shows a repeat of embodiment 42 with its finger 24 protrusions and cross member 44 for comparison purposes with FIG. 21. FIG. 21 shows the embodiment 42 with an add-on part, herein named an "Insert". The Insert type shown in FIG. 21, herein named a "Slotted Insert" 70 is installed over its cross member 44. The Slotted-Insert 70 may be rubber-like and hollow and have what is herein named an "Insertion Slot" 72. In practice, the Slotted-Insert 70 can be pressed between the embodiment 42's flexible, finger 24 protrusions and then slid over the embodiment 42 cross member 44 by means of spreading the insertion Slot 72 open to position the Slotted-Insert 70 around the center of the cross member 44. Once positioned, the Insertion Slot 72 closes allowing the Slotted-Insert 70 to resume its rounded shape over the cross member 44. During use, the Slotted-Insert 70 provides a similar functionality to that discussed for the embodiments 56 and 62. The user bites down on the Slotted-Insert 70. This causes the air in its center to escape through the Insertion Slot 72 allowing the user to experience added bite resistance while compressing the Slotted-Insert 70 and moving the finger 24 protrusions to extend to the gingivae pockets 16. FIG. 22 shows a cut-away view of the Slotted-Insert 70 with its Insertion Slot 72. Based upon its hollow center and the Insertion Slot 72, the Slotted-Insert 70 could be made in two halves, either molded or cast, and then bonded or glued together to form a whole Slotted-Insert 70.

Figure 23:
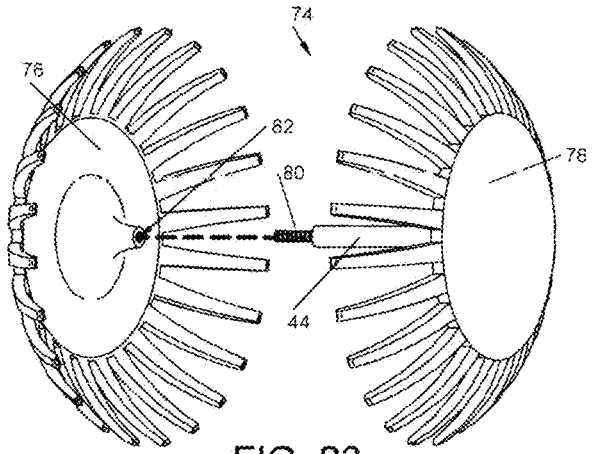
FIG. 23 depicts an embodiment of the apparatus of the invention similar to the FIG. 8 embodiment with a screw-like means to dis-connect and reconnect its two sides.
Figure 24:
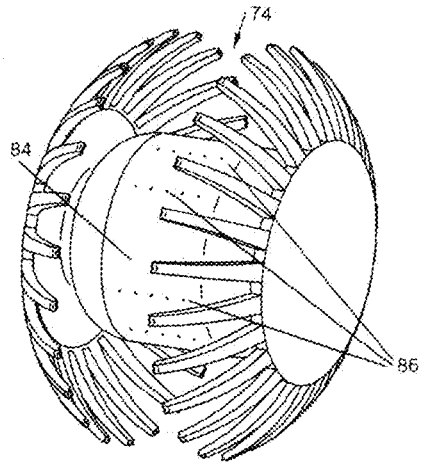
FIG. 24 depicts the FIG. 23 embodiment screwed together with an insert installed at its center.

FIG. 23 shows an embodiment 74 that may be seen as similar to embodiment 42 except for being a two-part assembly. A first half 76 may be unscrewed to separate and then screwed back in to join with a second half 78. The cross member 44 of the second half 78 has a treaded end 80 that screws into threaded hole 82 in the first half 76. Many other means to disconnect and reconnect the first and second halves 76 and 78 could be used. FIG. 24 shows the embodiment 74 screwed together with an add-on part, herein named a "Holed-Insert" 84. The Holed-Insert 84 may serve the same functions as the Slotted-Insert 70, namely improving the user's biting experience and allowing the finger 24 protrusions to extend to the gingivae pocket 16 by releasing air through a plurality of flow holes 86 when bitten on. The Holed-Insert 84 may also be an integral part of the two-part embodiment 74 making it a three-part assembly. In this case, the Holed-Insert 84 would be installed during the manufacturing stage and the three parts would be permanently connected by bonding or other means. The Holed-Insert 84 may be a springy sub-assemblage that allows the user to "chew" onto or into embodiment 74. The chewing causes repeated sliding up and down engagement of the finger 24 protrusions along outer teeth 48 and teeth 50 surfaces and in and out of the gingivae pockets 16. The Holed-Insert 84 may be made of a rubbery substance. As an add-on component to sample embodiments, the Holed-Insert 84, and variations thereof, may be designed as a disposable cartridge-like accessory containing any number of digestible formulations for general oral hygiene and bacterial inhibition or serve to promote plaque 18 debris removing salivation. In this case, the Holed-Insert 84 flow holes 86 may be slots or "X" cuts much like in micro-valves designed to restrict flow to one direction. As an add-on dispenser, the Holed-Insert 84 may be treated much like a food container and be sealed in a hygienic liquid-proof packaging to be shipped to stores, awaiting user purchase.

In practice, the user would unscrew or uncouple the two halves 76 and 78 of embodiment 74, install a Holed-Insert 84 onto cross member 44 and reconnect the assembly using threaded end 80 screwed into threaded hole 82. Next, the user positions the embodiment 74 between the teeth 48 and teeth 50 and commences chewing. As the user chews on the Holed-Insert 84, the biting pressure causes the formulation contained therein to be disbursed through the flow holes 86 in the Holed Insert 84 and out onto the teeth 48 and teeth 50 surfaces and into the gingivae pockets 16. Once the Holed-Insert 84 becomes depleted of its formulation it may be discarded and a new Holed-Insert 84 inserted onto cross member 44 in the embodiment 47. The two halves 76 and 78 of the embodiment 74 may then be reconnected for the next session of use. The Holed-Insert 84 may be a repository for digestible formulations whether permanently integrated into embodiment 74 or added on by the user. The formulation may be a liquid, gel or of another consistency.

Figure 25:
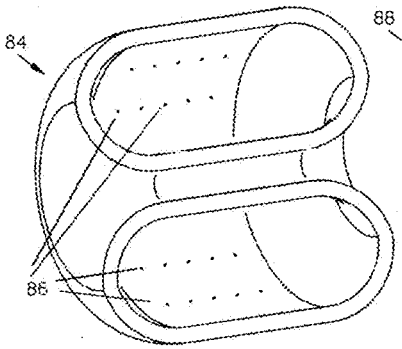
FIG. 25 depicts the FIG. 24 Insert bisected, exposing its hollow interior and holes in its outer wall.
Figure 26:
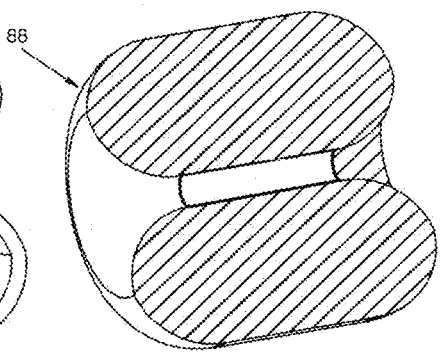
FIG. 26 depicts a bisected solid insert equal in size to the FIG. 24 insert exposing its solid interior.

FIG. 25 shows a halved view of a Holed-Insert 84 illustrating its hollow design and its flow holes 86. FIG. 26 illustrates a halved Insert similar to the Holed-Insert 84, herein named a "Solid Insert" 88. The Solid-Insert 88 may be made of a sponge-like or gummy-like springy formulation. Much like the Slotted-Insert 70 and the Holed-Insert 84, the spongy Solid-Insert 88 may provide the same functions such as improving the user's biting experience and allowing the finger 24 protrusions to extend to the gingivae pockets 16 by releasing air from the sponge-like material when bitten on or being squeezed by its gummy-like consistency. As with the Holed-Insert 84, the Solid-Insert 88 may be permanently installed or be an add-on component. In either case, if the Insert is highly absorbent, it may be the means to essentially "sop up" digestible formulations much like a tea bag or sponge. In use, if the Solid-Insert 88 is to be permanently installed in the embodiment 74, the entire embodiment 74 may be soaked in a formulation of choice. If removable, just the Solid-Insert 88 may be removed and dunked into the digestible formulation of choice. The Solid-Insert 88 may also be made of a somewhat resilient gummy-like chewable material that provides the user the sensation akin to chewing on a gummy candy, with the added benefit of promoting increased salivation that may be helpful in removing the plaque 18 debris from the gingivae pockets 16. In this case, the Solid-Insert 88 may serve the same functions as other inserts discussed, where the user's biting experience is improved, allowing the finger 24 protrusions to be able to extend to the gingivae pockets 16 by progressively squishing down the Solid-Insert 88 when bitten on and then being progressively dissolved. In the case of the use of a gummy-like Solid-Insert 88, the Insert may be commercially packaged for distribution and use.

With reference to the digestible formulations used in the apparatus, it is vital that the formulation are free of contaminants. In terms of the apparatus itself, all of the embodiments described herein may be quite small and made of materials that are amenable to cleaning. Given these factors, the entire apparatus may readily fit into a teacup filled with a cleaning formulation and then sterilized by heating, such as in a microwave. Also, simply washing and/or using a dishwasher to disinfect the apparatus may ensure cleanliness. A sponge filled with a digestible formulation may not be readily cleaned and sanitized. An embodiment having a sponge-like insert that is permanently installed may be deemed disposable after one use. A sponge-like Insert that can be an add-on and not part of the embodiment's permanent assembly, may be designated for one-time use, whether it be pre-filled with a formulation or not.

Figure 27:
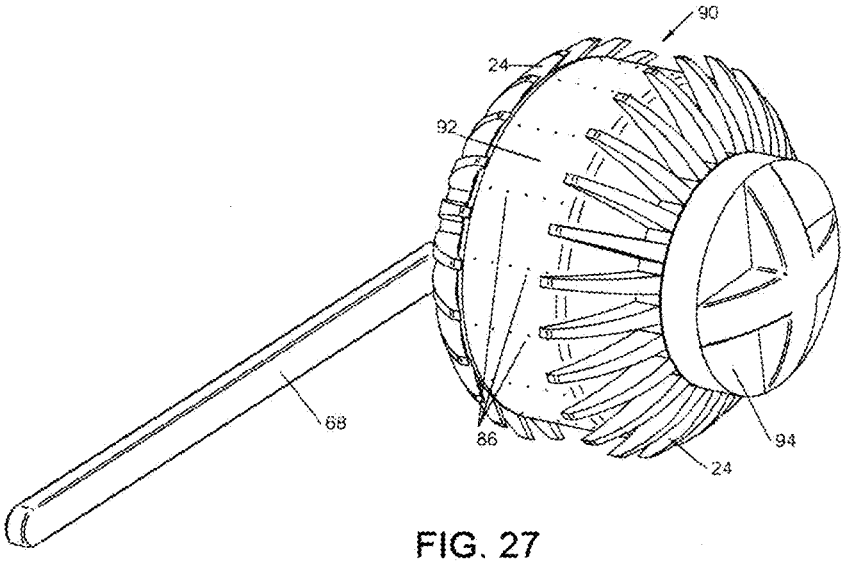
FIG. 27 depicts a perspective view of a sample bottle-like embodiment of the apparatus of the present invention.
Figure 28:
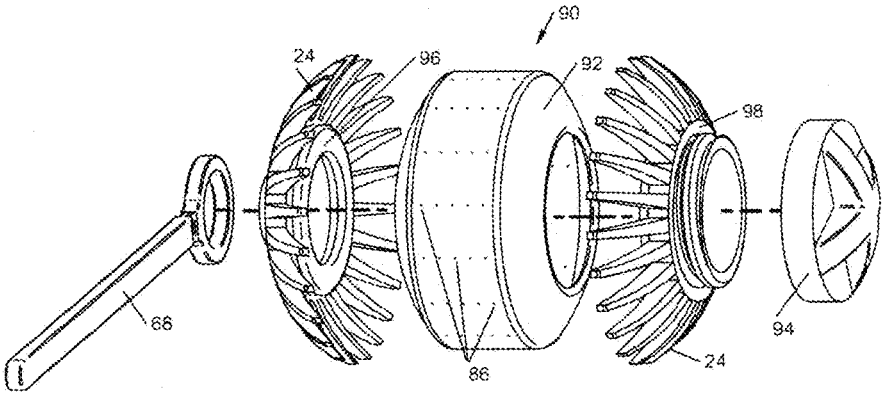
FIG. 28 depicts an exploded view of the FIG. 27 embodiment assembly with dashed lines showing an assembly path.
Figure 29:
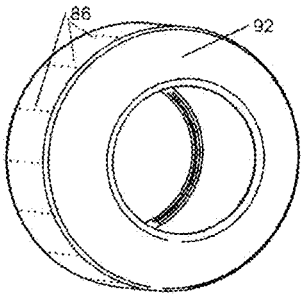
FIG. 29 depicts the FIG. 27 embodiment's insert hole.
Figure 30:
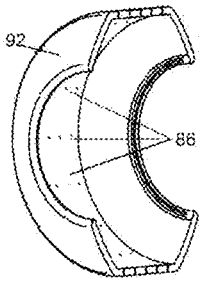
FIG. 30 depicts one half of the FIG. 27 embodiment insert hole, bisected.

FIG. 27 shows a bottle-like embodiment 90 with the finger 24 protrusions, a screw cap 94, a tire-like Holed Insert 92 with flow holes 86 and a rotatable Arm 68. FIG. 28 shows a perspective exploded view of the embodiment 90 assembly. All of the parts shown in FIG. 27 are shown plus first half 96 and second half 98 sides of the embodiment 90. A dashed line indicates the assembly path for the exploded parts. FIG. 29 shows the tire-like Holed-Insert 92 and FIG. 30 shows a halved view of the tire-like Holed-Insert 92. These figures illustrate the hollow nature of the Insert.

Embodiment 90 shown in FIG. 27, FIG. 28, FIG. 29 and FIG. 30 performs all of the plaque 18 clearing and cleaning functions as well as having the capability to be refilled with digestible formulations. Refilling the embodiment 90 may be a simple and familiar screw-on/screw-off routine for the user. Given the small capacity of embodiment 90 the user would likely use a small syringe to refill the embodiment 90 tire-like Holed Insert 92. The refillable embodiment 90 may provide users with the option to concoct their own formulations as for example, spinach or kale juice concoctions. Embodiment 90 may be assembled with the tire-like Holed-Insert 92 installed permanently. In this case the rubbery Insert would be assembled into the embodiment 90 much like a tire being installed on a rim. A solid version of the tire-like Holed-Insert 92 (not shown) may be made of a highly absorbent sponge-like material providing an option to soak the embodiment 90 in a digestible formulation for dissemination during use later on.

Figure 31:
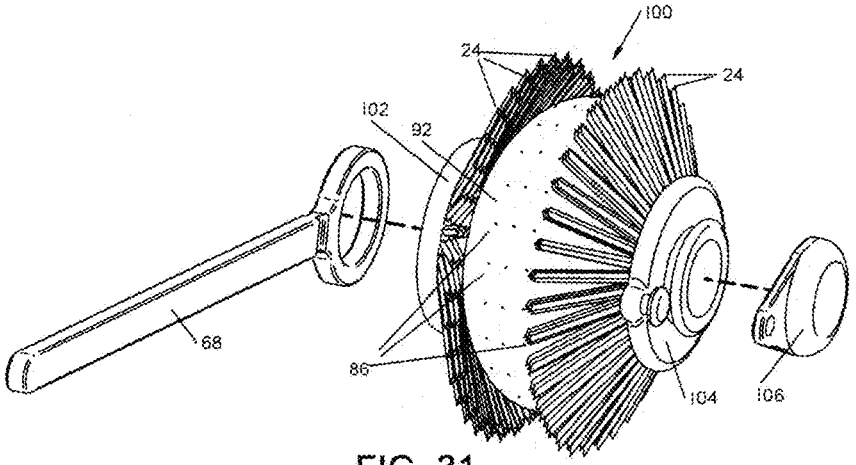
FIG. 31 depicts a perspective view of a partially exploded embodiment of the apparatus of the invention similar to the FIG. 27 embodiment with multiple rows of finger protrusions and a Snap-on bottle cap with dashed lines showing an assembly path.

FIG. 31 shows a partially exploded view of an embodiment 100 assembly with a tire-like Holed Insert 92, similar in function to embodiment 90. Embodiment 100 has multiple rows of a plurality of triangular finger 24 protrusions, first half 102 and second half 104 sides and a pop-on Bottle Cap 106 that may be snapped onto the second half 104. A rotatable Arm 68 is also illustrated. The exploded parts are shown separated by a dashed assembly line.

Figure 32:
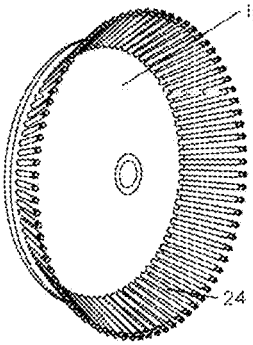
FIG. 32 depicts one side of a round hub-like assembly with a plurality of protrusions.
Figure 33:
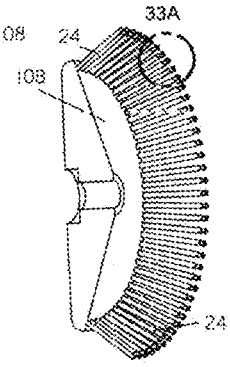
FIG. 33 depicts a halved cutaway of the FIG. 32 assembly showing an angled face.
Figure 33A:
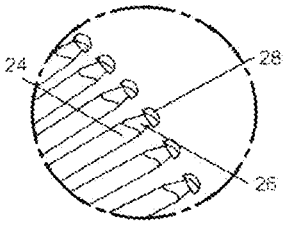
FIG. 33A depicts an enlarged partial view of the ends of the finger protrusions from FIG. 33.

FIG. 32 shows a part, herein named an "Angled Hub" 108, with a plurality of finger 24 protrusions. FIG. 33 illustrates a cut-in-half image of the Angled Hub 108 with an angled inner face. A facing pair of Angled Hubs 108 provide the means to dynamically adjust the operational separation between the Angled Hubs 108 and their finger 24 protrusions when in use. FIG. 33A shows a partially enlarged view of the Pull-Blade 26 and Bull Nose 28 profiles of the finger 24 protrusion ends in FIG. 33.

Figure 34:
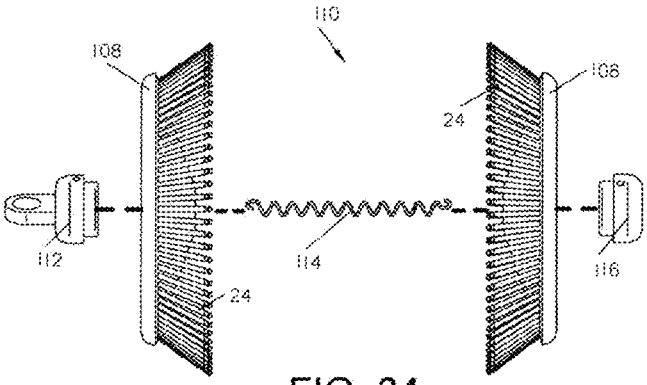
FIG. 34 depicts an exploded front view of a yo-yo like embodiment assemblage with dashed lines showing an assembly path.

FIG. 34 shows an exploded view of an embodiment 110 assemblage. When assembled, a pair of Angled Hubs 108 are pulled towards one another by a center spring 114 attached through the Angled Hubs 108 to an Arm pivot end cap 112 on one side of the embodiment 110 and to an end cap 116 on the other side of the embodiment 110. As an alternative to a metal center spring 114, the attraction of the two Angled Hubs 108 could be accomplished with a rubbery part, much like a rubber band. A dashed line shows the assembly path for the parts of the embodiment 110.

Figure 35:
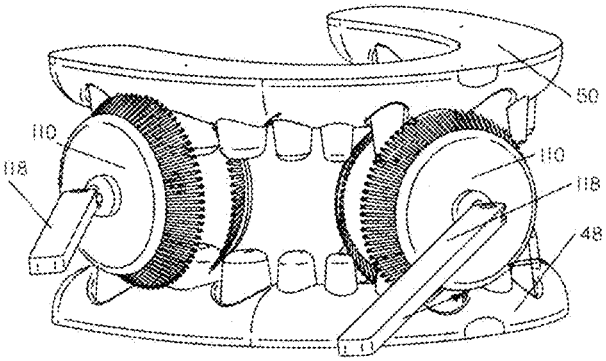
FIG. 35 depicts two FIG. 34 embodiments with arms between teeth in the upper and lower jaws. One arm is positioned between the molars and the other arm straddles the incisors.

FIG. 35 shows two images of the embodiment 110, each with an attached pivot Arm 118. One embodiment 110 is shown as straddling the molars and the other embodiment 110 is shown as over the incisors of the teeth 48 and teeth 50. In use, embodiment 110 can be placed into the user's oral cavity between the teeth 48 and teeth 50 as shown in FIG. 35. The widest outer opening of each Hub's inner sloped surfaces may be positioned to straddle the user's teeth 48 and teeth 50 biting surfaces. As the user bites down onto and into the embodiment 110, the user's teeth 48 and teeth 50 initially displace and bend the finger 24 protrusions. Then the user's teeth 48 and teeth 50 begin to impact the Angled Hub 108's inner sloped surfaces. As the user bites down further onto the Angled Hub 108, the center spring 114 reacts to the biting force causing the Angled Hubs 108 to separate, commensurate to the extent of the bite depth. As the bite depth increases the finger 24 protrusions continue to be repositioned closer to the gingivae pockets 16 resulting in the finger 24 protrusion ends engaging and disrupting dental plaque 18. As the bite depth advances further, the finger 24 protrusions reach the depth of the gingivae pockets 16. At this point, the most extended finger 24 protrusions begin to flex or spring away to forestall any gingival irritation or damage. As the user's bite retreats from the embodiment 110, the center spring 114 force on the Angled Hubs 108 inner inclined surfaces help to induce the embodiment 110's Angled Hubs 108 back to their original starting position prior to being bitten on. This allows for a recurring movement of the finger 24 protrusion ends into plaque 18 deposits in or near the gingivae pockets 16 as a result of the user's chewing.

Figure 36:
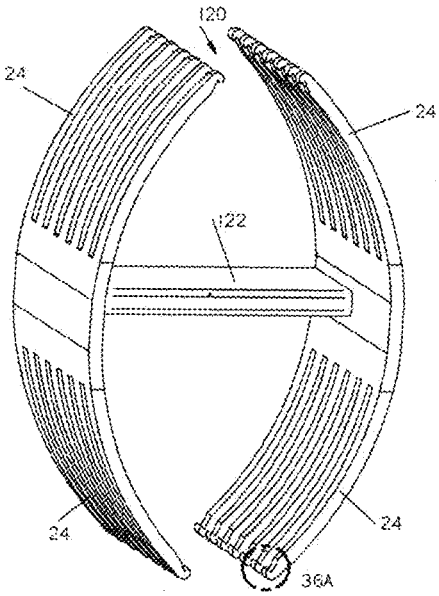
FIG. 36 depicts a perspective view of a square-like embodiment of the apparatus of the invention.
Figure 36A:
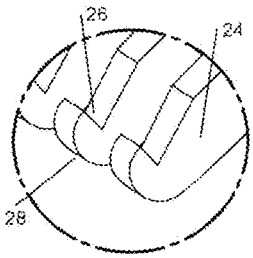
FIG. 36A depicts an enlarged partial view of the finger protrusion ends of the FIG. 36 embodiment.
Figure 37:
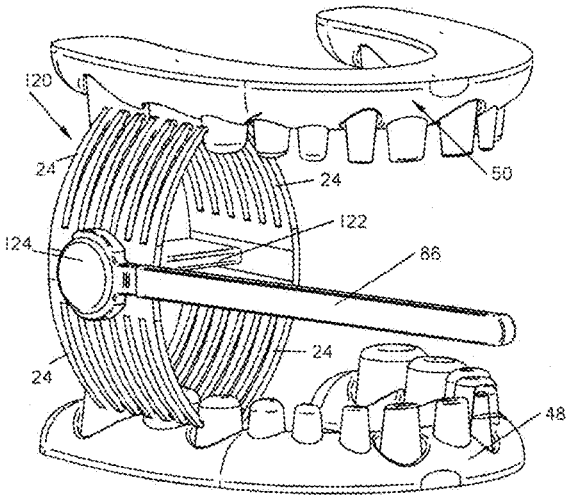
FIG. 37 depicts the FIG. 36 embodiment with an arm positioned between the teeth in the upper and lower jaws.

FIG. 36 shows a one-piece square-shaped embodiment 120 with a plurality of finger 24 protrusions oriented both upwards and downwards on both sides. A half-width cross member 122 joins the two sides of the embodiment 120 together. FIG. 36A shows a partial enlarged view of the embodiment 120's Bullnose 28 and Pull-Blade 26 profiles at the ends of the finger 24 protrusions. FIG. 37 shows the embodiment 120 with its finger 24 protrusions positioned around teeth 48 and teeth 50. The embodiment 120 is shown with a pivot Arm 118 positioned on an Arm guide 124. The pivot Arm 118 may be useful in moving the embodiment 120.

The shape of the plurality of embodiments may be of little or no consequence relative to functionality. Although a roundish design, as with embodiment 42, may impose an array of differing finger 24 protrusion lengths upon first contact with the gingivae pockets 16, the squarer design of embodiment 120 offers a broader engagement of finger 24 protrusions of the same length upon their first contact with the gingivae pockets 16. In either case, the finger 24 protrusions may be readily directed into the gingivae pockets 16 for the cleaning purposes described herein.

Figure 38:
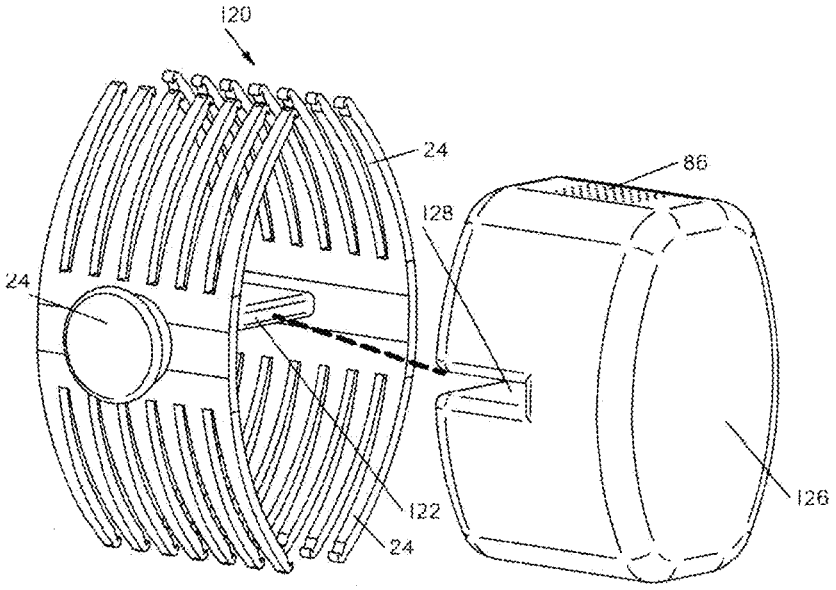
FIG. 38 depicts an exploded view of the FIG. 37 embodiment and an uninstalled insert with holes, showing a dashed line insertion path.

FIG. 38 shows the embodiment 120 with a square Holed-Insert 126 exploded out with an insertion path in dashed line. The square Holed Insert 126 may be designed to be readily installed and de-installed by simply slipping the square Holed Insert 126 on and off the half-width cross member 122 within the embodiment 120. Flow holes 86 are shown at the square Holed Insert 126 top. An arm guide 124 is shown to be used to optionally attach a rotatable Arm 68 to the embodiment 120. The square Holed Insert 126 may serve to improve the user's biting experience and allow the finger 24 protrusions to extend to the gingivae pockets 16 by releasing air through the flow holes 86 when bitten on. The resilient push-back of a rubber-like insert may also accentuate a Pull-Blade 26 effectiveness in clearing plaque 18 as the user proceeds to release the bite on the embodiment. This benefit would relate to all Inserts shown within the various embodiments of the apparatus. The square Holed-Insert 126 may be an add-on component for end-users as a disposable cartridge-like accessory containing any number of different digestible formulations for general oral hygiene and bacterial inhibition or may serve to promote plaque 18 debris removing salivation. As an add-on component, the square Holed-Insert 126's flow holes 86 may be micro-slots or micro-"X" cuts much like those in tiny silicone valves designed to allow flow in one direction. As a cartridge, the square Holed-Insert 126 would then be treated much like a food container and be sealed in consumer-ready liquid-proof packaging and shipped to and inventoried by retailers awaiting user purchases. As an add-on vessel for dispensing formulations, the user's chewing pressure on the square Holed-Insert 126 causes the enclosed formulation to be pressure-squeezed and squirted out through its flow holes 86 and onto the user's teeth 48 and teeth 50 and into the user's gingivae pockets 16.

Figure 39:
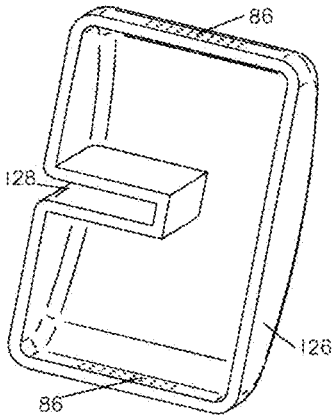
FIG. 39 depicts one half of the FIG. 38 insert bisected.
Figure 40:
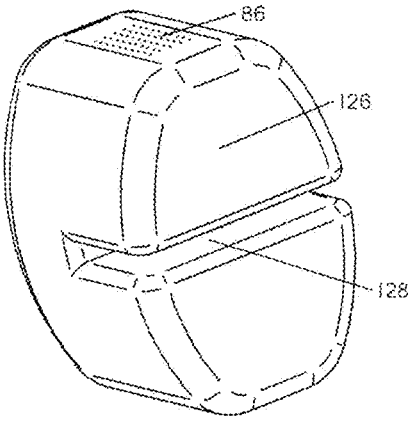
FIG. 40 depicts the FIG. 38 insert.

FIG. 39 shows an image of the square Holed-Insert 126 halved to illustrate its internal structure and its flow holes 86 on both the top and bottom of the Insert. FIG. 40 illustrates the whole square Holed-Insert 126 with a cross member slot 128 and flow holes 86.

Figure 41:
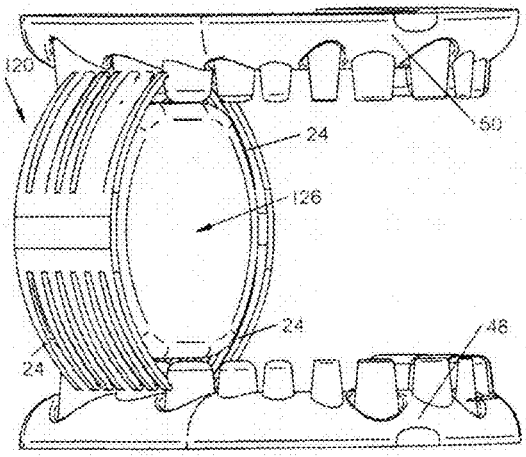
FIG. 41 depicts the FIG. 36 embodiment between the teeth in the upper and lower jaws with the insert installed.

FIG. 41 shows the embodiment 120 with two square Holed-Inserts 126 installed and positioned between the teeth 48 and teeth 50. As a user bites down on the embodiment 120 the teeth 48 and teeth 50 biting surfaces first engage the finger 24 protrusion ends. Once the finger 24 protrusions are displaced in a spring-like manner and then positioned onto the sides of the teeth 48 and teeth 50, the user's teeth 48 and teeth 50 impact the square Holed Insert 126. As the user continues to bite down, the finger 24 protrusion ends proceed towards the gingivae pockets 16. The further closing of the teeth 48 and teeth 50 bite decreases the size of the square Holed Insert 126 causing its contents to be ejected through the Insert's flow holes 86 onto the teeth 48 and teeth 50 and into the gingivae pockets 16.

Figure 42:
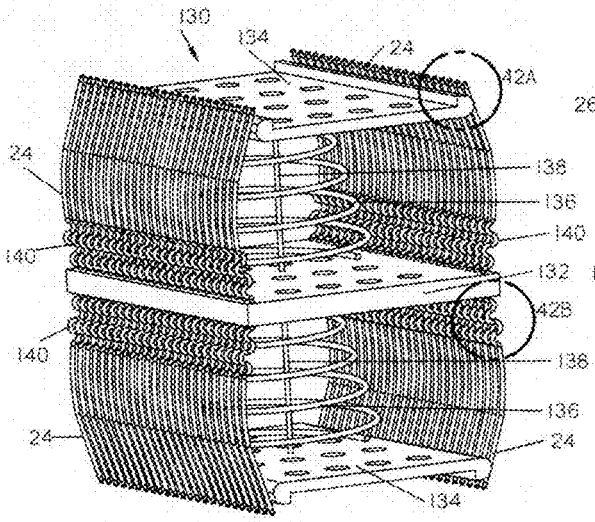
FIG. 42 depicts a linear-shaped embodiment of the apparatus of the invention that uses springs.

FIG. 42 illustrates an embodiment 130 that has a flat central cross member 132, two tooth pads 134, two center springs 136 and two tethers 138. Prior embodiments have had their finger 24 protrusions angled inwards to be positioned narrower than the width of teeth 48 and teeth 50 ensuring that the finger 24 protrusions exert spring-like pressure against teeth 48 and teeth 50 no matter how narrow teeth 48 and teeth 50 profiles may be. As shown for embodiment 42 in FIG. 11 as the user bites into the embodiment, the flexible finger 24 protrusions bend inwards allowing the teeth 48 and teeth 50 to become positioned in between the rows of the embodiment finger 24 protrusion ends. The finger 24 protrusions of embodiment 130 are also sprung and angled towards the teeth 48 and teeth 50. But, in the case of embodiment 130 the finger 24 protrusions are made to be more rigid. So, when the user first bites down on the embodiment 130, the finger 24 protrusions may not be flexible enough to bend out of the way and then recover to their original shape to interface with the teeth 48 and teeth 50 outer surfaces. To remedy this, the four rows of the finger 24 protrusions of embodiment 130 are held apart by tooth pads 134 between them. This separation enables users to bite onto the embodiment 130 tooth pads 134 because the finger 24 protrusion ends are initially positioned outside the inner and outer surfaces of the teeth 48 and teeth 50 when the embodiment 130 is first positioned between teeth 48 and teeth 50. By design, embodiment 130 may have the finger 24 protrusions made of a rigid material, such as metal or other springy material thus enhancing the finger 24 protrusion stiffness and blade edge cutting capability and durability.

Figure 42A:
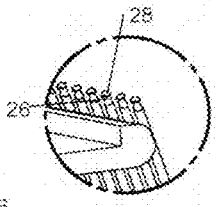
FIG. 42A shows an enlarged partial view of bullnose shaped ends of the FIG. 42 embodiment and FIG. 42B shows an enlarged partial view of the FIG. 42 embodiment finger protrusions with spring-like configurations.
Figure 42B:
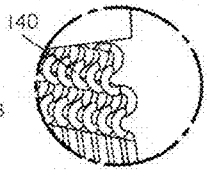

FIG. 42A shows a partial enlarged image of the ends of the embodiment 130 finger 24 protrusions with their Bull Noses 28, that provide protection for soft gingival tissue, and Pull Blade 26 profiles. Also shown in FIG. 42, and in the partial enlarged FIG. 42B, the finger 24 protrusions have a spring base 140 configuration. This allows the finger 24 protrusions to dynamically adjust their length as they come in contact with varying depths of the user's gingivae pockets 16. This spring base 140 enhances the ability of the finger 24 protrusions to reach into varying depths of gingivae pockets 16 and, upon contact with the gingivae pocket 16 depth, spring back to protect the soft tissue from injury. In addition, the embodiment 130 finger 24 protrusions have Pull Blade 26 profiles, allowing them to clear plaque 18 as they retreat from the gingivae pockets 16 driven by the return pressure from the center springs 136.

FIG. 42 further shows embodiment 130 having the finger 24 protrusions with a bowed-outwards profile. The tooth pads 134 at the embodiment 130's top and bottom provide the means to engage the user's teeth 48 and teeth 50 biting surfaces. The tooth pads 134 are pushed apart to a "home position" by the upwards and downwards pressure of the two center springs 136 and then restrained from moving beyond the home position by a plurality of tethers 138. In their static un-bitten home position, the tooth pads 134 outer sides abut the inner surface of the finger 24 protrusions inhibiting their inward movement in spite of the finger 24 protrusions inwards spring-like tension to do so. As the user bites onto the embodiment 130's tooth pads 134, the center springs 136 are compressed allowing the tooth pads 134 to advance towards the flat central cross member 132. In moving the tooth pads 134 from their home position, the finger 24 protrusions bowed-out profile follow the outer sides of the tooth pads 134 until the finger 24 protrusion ends engage the sides of the teeth 48 and teeth 50 in a spring-like fashion. The finger 24 protrusions then no longer press against the outer sides of the tooth pads 134. Because of the bowed-out profile of the finger 24 protrusions at any point that the user's bite has displaced the tooth pads 134 from the home position, the finger 24 protrusions are freed to maintain contact with the teeth 48 and 50 surfaces and not with the sides of the tooth pads 134. As the user releases the bite, the inward spring tension of the bowed finger 24 protrusions maintain contact with the sides of the teeth 48 and teeth 50 surfaces until the tooth pads 134 arrive at or near the home position. At that point, driven by the center spring 136's upward and downward expansive pressure on the tooth pads 134, the inner surface of the bowed-out finger 24 protrusions resume contact with the sides of the tooth pads 134 and are thus driven open and held in the home position by the restraint of the tethers 138. Once the finger 24 protrusions inner surfaces are back to their home position, the user may again bite onto the tooth pads 134 to restart the embodiment 130's use. This sequence may be repeated each time the user chews on and releases the teeth 48 and teeth 50 from the home position of the embodiment 130.

Figure 43:
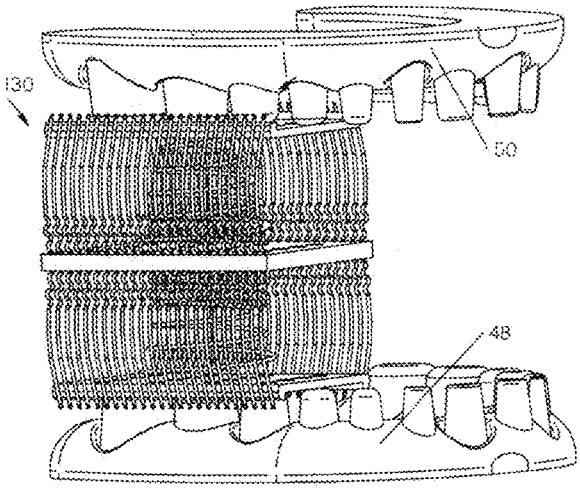
FIG. 43 depicts the FIG. 42 embodiment positioned between the teeth in the upper and lower jaws.
Figure 44:
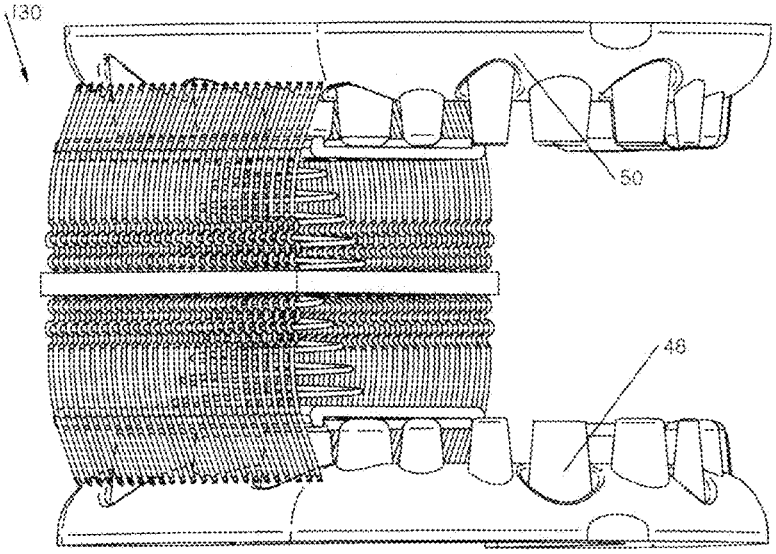
FIG. 44 depicts the FIG. 42 embodiment positioned between the teeth with the upper and lower jaws partially closed.

FIG. 43 shows the embodiment 130 positioned between teeth 48 and teeth 50 in the embodiment 130's home position. FIG. 44 shows the embodiment 130 positioned between the teeth 48 and teeth 50 with the jaws partially closed and the center springs 136 compressed, moving the tooth pads 134 towards the flat central cross member 132. This causes the finger 24 protrusions to engage the teeth 48 and teeth 50 surfaces with the finger 24 protrusion ends traveling towards and into the gingivae pockets 16.

Figure 45:
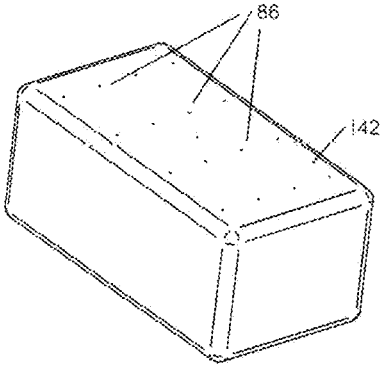
FIG. 45 depicts a square shaped insert.
Figure 46:
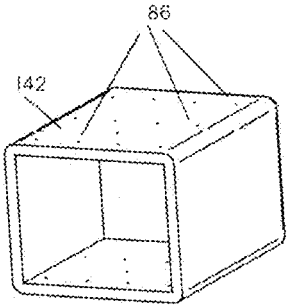
FIG. 46 depicts one half of a cut-away of the FIG. 45 insert.

FIG. 45 shows an intact long Holed-Insert 142 with its flow holes 86 and FIG. 46 shows the long-Holed Insert 142 cut-away, illustrating its hollow interior. Although the long-Holed Insert 142 may be hollow, as already discussed, other Insert types could be used such as a solid version of the long Holed-Insert 142, possibly made of a gummy-like formulation or similar edible ingredients.

Figure 47:
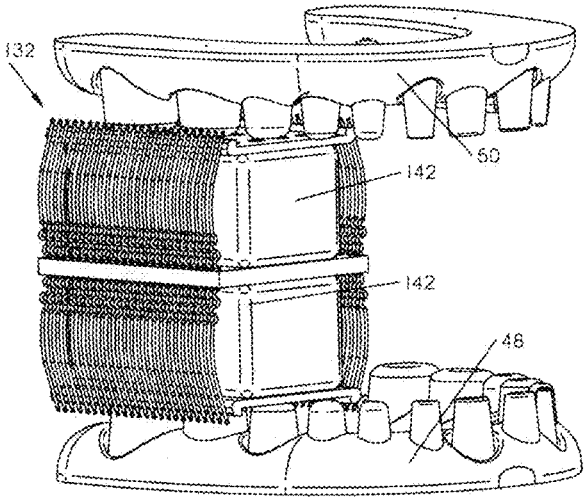
FIG. 47 depicts the FIG. 42 embodiment with the springs replaced by two inserts.

FIG. 47 shows the embodiment 130 with two long Holed-Inserts 142 installed. The long Holed Inserts 142 may replace the center springs 136 and the tethers 138 by being made of a springy material sufficient to reposition the tooth pads 134 to home position and overcome the inward torque of the finger 24 protrusions sufficient to spread the finger 24 protrusion ends to allow the user to bite onto the tooth pads 134 in embodiment 130. In this case, the long-Holed Inserts 142 would have to be permanently installed in embodiment 130.

Figure 48:
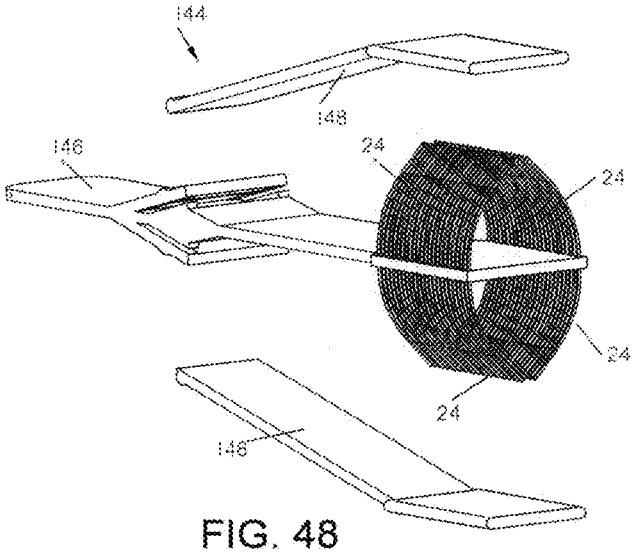
FIG. 48 depicts a perspective view of a disassembled embodiment of the apparatus of the invention with a plurality of finger protrusions and two unattached arms.

FIG. 48 shows a disassembled embodiment 144 with a pair of unattached parts, each herein named a "Lever Arm" 148, and a flattened cross member 146 having a plurality of finger 24 protrusions emanating from both sides and on the top and bottom of the flattened cross member 146.

Figure 49:
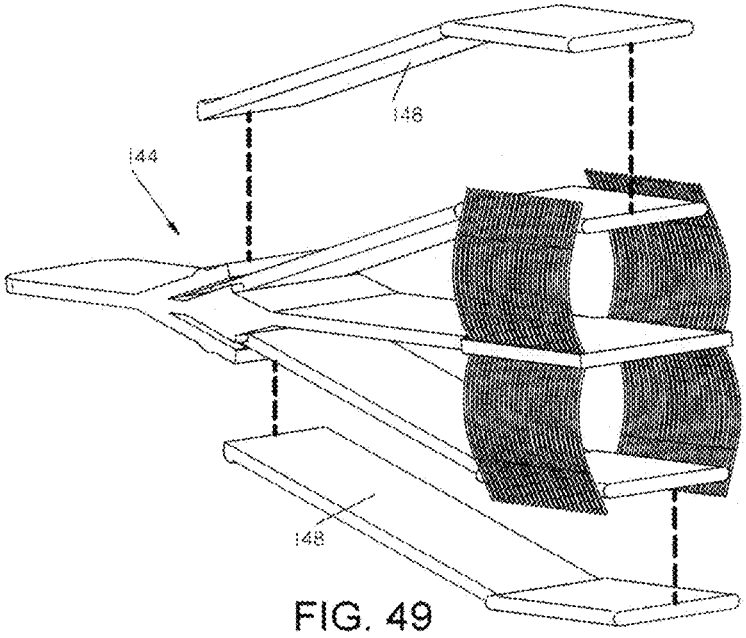
FIG. 49 depicts the FIG. 48 embodiment assembled with two additional arms having dashed-line assembly paths.
Figure 50:
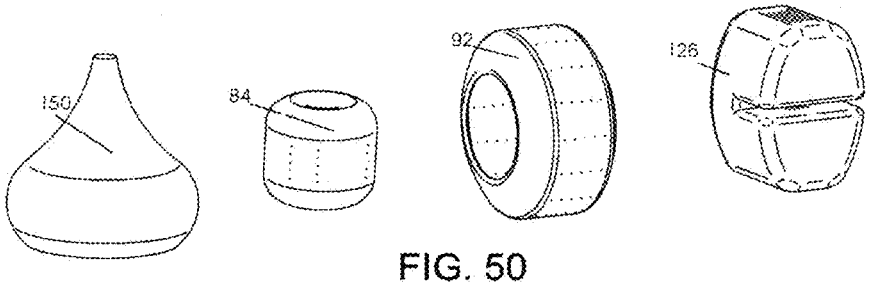
FIG. 50 depicts a comparison between a candy kiss insert and three previously illustrated inserts.

FIG. 49 shows an assembled embodiment 144 with separate uninstalled images of Lever Arms 148 showing dashed-line insertion paths. The embodiment 144 functions in a similar fashion to the embodiment 130. Instead of center springs 136 or long Holed Inserts 142 driving tooth pads 134 apart to the home position, the Lever arms 148 use a dual springboard-like tension to restore the embodiment 144's Lever arms 148 to their home position. Although the Lever arms 148 may be integrated into a one-piece embodiment 144, by having the Lever arms 148 made separate, the material used for the Lever arms 148 may be better suited for the springiness needed. In addition, the insertion of the Lever arms 148 between the embodiment 144 bowed-out finger 24 protrusions readily allows leveraging of the finger 24 protrusions apart as the Lever Arms 148 are inserted to make the assembled embodiment 144 ready for use. In terms of operation, as the user bites onto the Lever arms 148, the Lever arms 148 move towards the flattened cross member 146 allowing the outward curve of the finger 24 protrusions to disengage from the outer sides of the Lever arms 148 and cause the finger 24 protrusion ends to engage the inner and outer surfaces of the teeth 48 and teeth 50. In the same manner, as with embodiment 130, as the user releases the bite on the Lever arms 148 and the Lever arms 148 return to being at or near the home position, the finger 24 protrusions are spread apart and separated from the inner and outer surfaces of the teeth 48 and teeth 50. Relative to the clearing of plaque 18, the closing and opening of the Lever arms 148 relative to the flattened cross member 146 caused by the biting motion of the user also moves the finger 24 protrusion ends up and down on the teeth 48 and teeth 50 surfaces, driving the finger 24 protrusion ends through the plaque 18 deposits and into and out of the gingivae pockets 16. The embodiment 144 may also have Inserts installed between the flattened cross member 146 and the Lever arms 148 to serve as an adjunct means to help initially keep the Lever arms 148 separated and positioned at their home position and possibly to dispense formulations FIG. 50 shows a comparison in size between a typical chocolate kiss 150 and three of the Inserts already shown, namely; the Holed-Insert 84 or Solid-Insert 88, the tire-like Holed Insert 92 and the square Holed Insert 126. These images illustrate the similarity in size with a chocolate kiss and the viability of using small springy candy-like modules, like gummies, as Inserts. Relative to embodiments like 130 and 144, it may be important to note that the finger 24 protrusions may be made of metal or other springy hard materials. The relative thinness of the finger 24 protrusions may be adequate to allow for the springiness needed. The Bull Nose 28 profiles may adequately protect the soft gingival tissue even if the finger 24 protrusions are made of metal or other hard substances.

Figure 51:
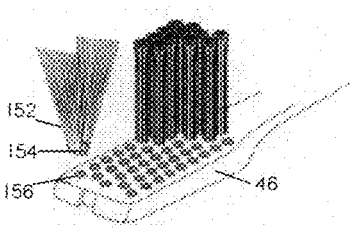
FIG. 51 depicts a conceptual sketch of a production methodology for stapling bristles into a toothbrush.

FIG. 51 shows a simple representation of an automation process that may be used to assemble bristles 152 into a toothbrush 46. Lengths of bristles 152 are grouped together and then automatically folded in half and positioned into the toothbrush holes 156 within a handle of a toothbrush 46. The bristles 152 are then secured into the toothbrush holes 156 with tiny metal staples 154.

Figure 52:
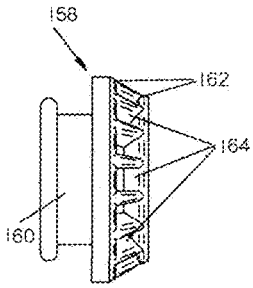
FIG. 52 depicts a side view of a hub-like part with holes.
Figure 53:
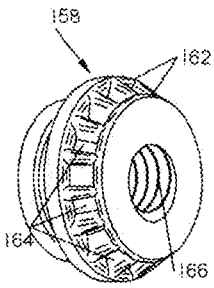
FIG. 53 depicts the FIG. 52 part from a perspective view.

FIG. 52 shows a side view and FIG. 53 show a perspective view of a wheel-like part, herein named a "Hub" 158. For purposes here, the Hub 158 essentially replaces the toothbrush 46 as the recipient of bristles 152. The bristles 152 are attached to the Hub 158 in a fashion similar to the process described in FIG. 51. In FIG. 52 and FIG. 53, the Hub 158 is shown to have a Hub Arm guide 160 and a series of bristle holes 164 cut into an angled face 162 and a threaded mounting hole 164. The bristle holes 164 are formed to allow for the insertion and stapling of bristles 152. The angle of the angled face 162 on the Hub 158 can be cut to properly align bristles 152 against teeth 48 and teeth 50 surfaces during Apparatus use.

Figure 54:
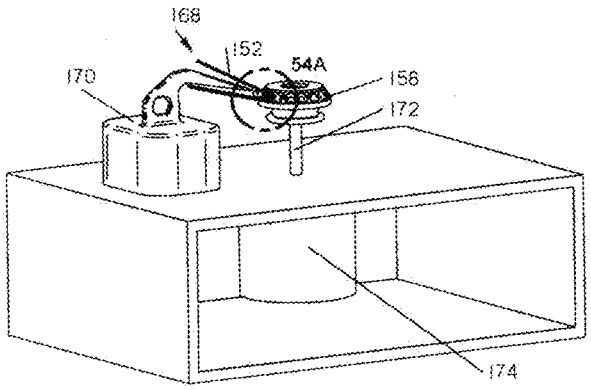
FIG. 54 depicts a conceptual image of a stapling machine.
Figure 54A:
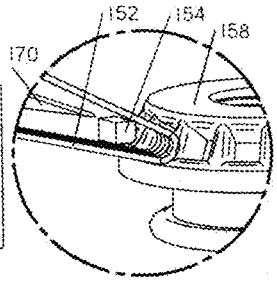
FIG. 54A depicts a partially enlarged view of bristles ready to be stapled into the FIG. 52 part by the FIG. 54 stapling machine.

FIG. 54 illustrates a conceptual bristle 152 stapling machine 168. During bristle 152 stapling, the Hub 158 may be positioned on the stapling machine 168 with a stapler 170 mechanism and screwed onto a motor 174-driven spindle 172 by means of a threaded mounting hole 166. As the spindle 172 turns the Hub 158, the stapling machine 168's timing aligns and inserts the folded bristles 152 into the revolving bristle holes 164 in the Hub 158. The stapling machine 168 then automatically fixes the bristles 152 grouping in the bristle hole 164 with a staple 154 from the stapler 170. In FIG. 54A, a partial enlarged view shows the folded bristles 152 being positioned adjacent to the bristle hole 164 to be fixed in place by the stapler 170 with a metal staple 154, similar to the automated process of attaching bristles 152 into toothbrush holes 156, as shown in FIG. 51.

Figure 55:
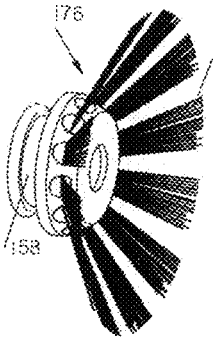
FIG. 55, FIG. 56 and FIG. 57 depict three assemblages of FIG. 52 parts with different groupings of bristles installed.
Figure 56:
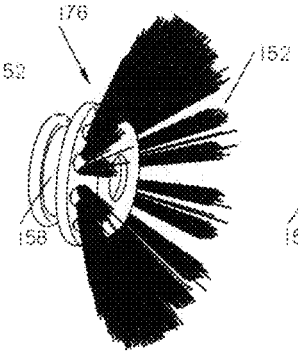
Figure 57:
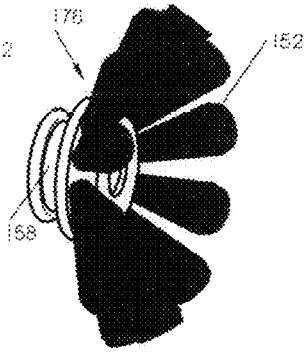
Figure 58:
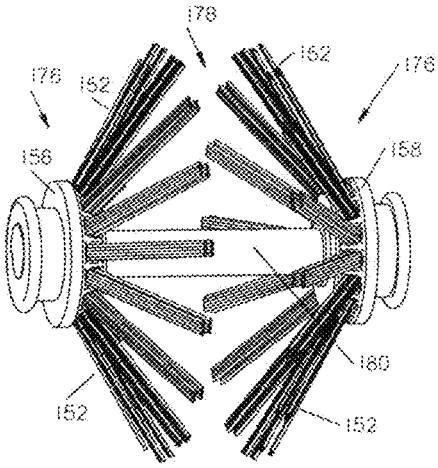
FIG. 58 depicts a perspective view of an embodiment of the apparatus of the invention having two FIG. 55 assemblies with a cross member.
Figure 59:
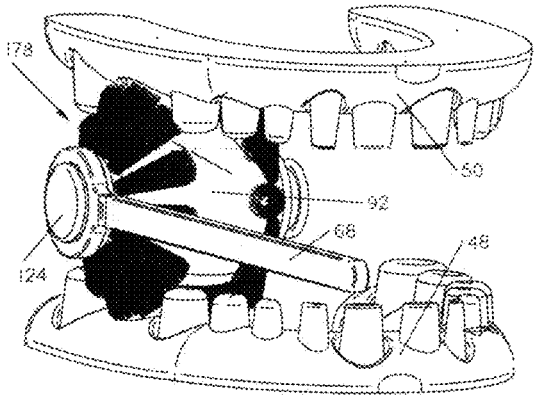
FIG. 59 depicts the FIG. 58 embodiment with an arm installed and positioned between the teeth in the upper and lower jaws.

FIG. 55, FIG. 56 and FIG. 57 illustrate three Hub assemblies 176, each with a differing amount of bristles 152 installed into their Hub 158 angled faces 162. FIG. 58 shows an embodiment 178 composed of two Hub assemblies 176 having typical toothbrush-width bristles 152 installed as described in FIG. 54 and FIG. 54A. The two Hubs assemblies 176 are joined together facing one-another by a bristle cross member 180. FIG. 59 shows the embodiment 178 positioned between teeth 48 and teeth 50 with a tire-like Holed-Insert 92 installed. The Arm guide 124 and rotatable Arm 68 are also shown as installed and may be used to move or reposition the embodiment 178. As the user bites down on the embodiment 178, the bristles 152 move along teeth 48 and teeth 50 surfaces and through plaque 18 deposits until they encounter the gingivae pockets 16. Once bristles 152 abut the depth of a gingivae pocket 16, the bristles 152 flex without causing damage to the soft tissue.

Figure 60:
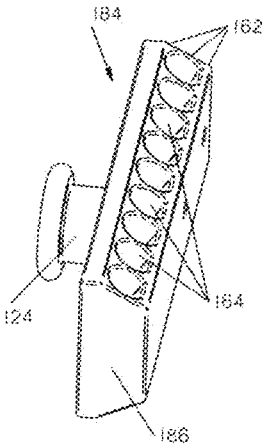
FIG. 60 depicts a perspective image of a linear shaped part with holes.
Figure 61:
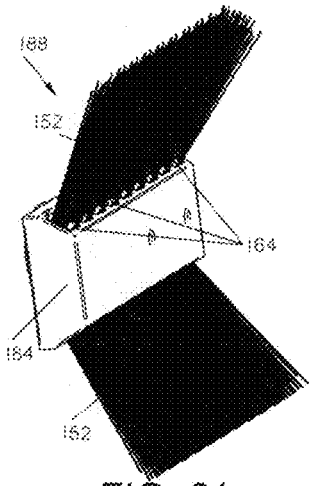
FIG. 61 depicts a perspective view of an assembly of the FIG. 60 part with bristles installed in the holes.

FIG. 60 shows a part herein named a "Rail" 184 composed of a Rail body 186, an Arm guide 124 and a series of bristle holes 164. The Rail 184 is nothing more than a Hub 158 straightened out. The Rail body 186 can be used to attach bristles 152 within square-like embodiments, such as embodiment 190 shown in FIG. 62. The bristles 152 may be anchored to the Rail 184's angled face 162 by means of a methodology similar to the one described in FIG. 54 and FIG. 54A and very much like attaching bristles 152 to toothbrushes 46 as shown in FIG. 51. FIG. 61 shows a Rail assembly 188 with the Rail 184 having bristles 152 installed emanating from bristle holes 164 in the Rails 184's two angled faces 162.

Figure 62:
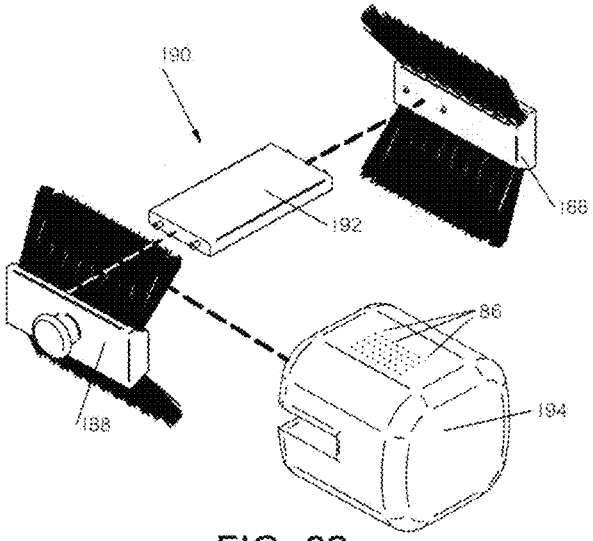
FIG. 62 depicts an embodiment of the apparatus of the invention with a pair of FIG. 61 assemblies exploded apart from a cross member with dashed assembly lines. An insert is also shown with a dashed insertion line.
Figure 63:
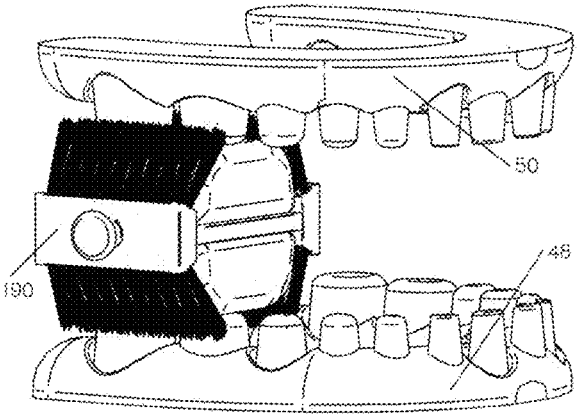
FIG. 63 depicts the FIG. 62 embodiment assembled and positioned between the teeth in the upper and lower jaws.

FIG. 62 shows an exploded view of an embodiment 190 with a pair of Rail assemblies 188 and a half-pinned cross member 192 shown with dashed assembly line. A small-square Holed-Insert 194 is also shown with a dashed insertion line. FIG. 63 shows the embodiment 190 assembled and positioned between teeth 48 and teeth 50. As the user bites down on the embodiment 190, the air in the small-square Holed-Insert 194 can be expelled to allow deflation of the Insert or, if filled with a formulation, the formulation may be disbursed threw the flow holes 86 and onto the teeth 48 and teeth 50 surfaces and into gingivae pockets 16. As bristles 152 abut the depth of a gingivae pocket 16, the bristles 152 flex to avoid damage to the soft tissue in the gingivae pockets 16.

FIG. 64 shows an illustration of a conceptualized opposing two-wheel fabricated bristle shaper and cutter machine, herein named a "Mechanism" 196. A wire-like feed of synthetic bristle-like material, herein named a "Bristle Extrusion" 200, may be fed into the Mechanism 196. The Mechanism 196 has synchronized wheels with opposing identical dies, herein named "Opposing Dies" 198. The Opposing Dies 198 each have carved-out voids of half the desired profile and length of a fabricated bristle, herein named "Fabricated Bristle" 202. As the Opposing Dies 198 turn, the fed-in Bristle Extrusion 200 can be compressed into the Fabricated Bristle 202 shape, cut off and then deposited into a hopper or the like. As with synthetic or natural bristles 152 used in toothbrushes 46, the newly Fabricated Bristles 202 are assembled into clusters and positioned to be fed into the stapling machine 168 to be folded and stapled into Hubs 158 or Rails 184 within the embodiments designed to work with Fabricated Bristles 202. FIG. 64A shows a partial enlarged view of a section of the Opposing Dies 198 with; a series of cutters 204 that cut off Fabricated Bristles 202 as they are formed, half cutouts voids for the Pull Blade 26 ends of the Fabricated Bristles 202 and half cutouts voids for the Fabricated Bristle shaft 206 itself. The Pull-Blade 26 type of Fabricated Bristle 202 form discussed in FIG. 64A and is herein named a "Pull-Blade Fabricated Bristle" 212 and further discussed relating to following figures. FIG. 64B shows a further partially enlarged view of the elements defined on FIG. 64A.

FIG. 65 shows images of a size comparison of a typical toothbrush 46 bristle 152 and a length of pencil lead 218 with images of Fabricated Bristles 202. Specifically, the comparison is with a coiled Fabricated Bristle 208, a bent end Fabricated Bristle 210, a Pull-Blade Fabricated Bristle 212, a Push-Blade Fabricated Bristle 214 and a Push-Pull Fabricated Bristle 216. FIG. 65A shows a partial enlarged view of the end of a typical toothbrush 46 bristle 152 cut square. For all intents and purposes, the bristle 152 has a push type end profile. This means that toothbrush type bristles 152 are limited to pushing against plaque 18 in an attempt to clear its mass and would tend to push plaque 18 debris into gingivae pockets 16. In partially enlarged views in FIG. 65B, FIG. 65C and FIG. 65D, Blade and Bull Nose 28 profiles are shown. FIG. 65B shows a partially enlarged view of one end of the Pull-Blade Fabricated Bristle 212 with a Pull-Blade 26 profile. FIG. 65C shows a partially enlarged view of one end of the Push-Blade Fabricated Bristle 214 with a Push-Blade 30 profile. FIG. 65D shows a partially enlarged view of one end of the Push-Pull Blade Fabricated Bristle 216 with a Push-Pull Blade 32 profile. As with the finger 24 protrusions, the Fabricate Bristles 202 Blade features may also be placed repeatedly along the length of the Fabricate Bristles 202 to increase the Plaque 18 clearing capability of the Fabricate Bristles 202 outside of the gingivae pocket 16 area.

FIG. 66 shows a size comparison of images of the typical toothbrush bristle 152 and the length of pencil lead 218 with images of folded Fabricated Bristles 202. As described in FIG. 51, an automation process used to install bristles 152 groups them together then automatically folds them in half, positions the groups of bristles 152 and then staples them into holes with a metal staple 154. The idea here relative to Fabricated Bristles 202 may be to treat them as if they were bristles 152 to be installed in the sample embodiments described herein. This means that the Fabricated Bristles 202 produced by the Mechanism 196 would be in many ways like synthetic bristles 152 used to populate toothbrushes 46 except for the Fabricated Bristles 202 having Bull Nose 28 and Blade ends. So, relative to the images shown in FIG. 66, FIG. 66A, FIG. 66B, FIG. 66C and FIG. 66D the folding in half of the Fabricated Bristles 202 may be thought of as preparation for their installation as described in FIG. 54 and FIG. 54A relative to Hubs 158 and Rails 184. As shown in FIG. 6 the bent end Fabricated Bristle 210 from FIG. 65 illustrated as a folded bent end Fabricated Bristle 220, the Pull-Blade Fabricated Bristle 212 from FIG. 65—illustrated as a folded Pull-Blade Fabricated Bristle 222, the Push-Blade Fabricated Bristle 214 from FIG. 65—illustrated as a folded Push-Blade Fabricated Bristle 224 and the Push-Pull Fabricated Bristle 216 from FIG. 65—illustrated as a folded Push-Pull Fabricated Bristle 226.

The embodiments of the apparatus of the invention and their finger 24 protrusions presented are generally made of molded or other materials capable of casting. Although artificial and natural fibers or bristles 152 are used extensively in toothbrushes 46, generally toothbrushes 46 are not suitable to effectively clear gingivae pockets 16 of plaque 18 deposits. This has much to do with the angle needed to be maintained by toothbrush 46 bristles 152 to properly engage plaque 18 deposits within the gingivae pockets 16 as well as the general arrangement of toothbrush 46 bristles 152 positioned and grouped to form brush-like configurations. But the tiny girth of bristles 152 makes them suitable for getting into very small crevasses and bristles 152 may be very springy. Properly orientated, bristles 152 may readily follow the contour of teeth 48 and teeth 50 right into the gingivae pockets 16. Bristles 152, both synthetic and natural, may be used in some embodiments as a substitute for finger 24 protrusions. Bristles 152 may be arranged in clusters, somewhat like the arrangement in a toothbrush 46, and may possess a wide range of thicknesses and rigidity factors. Bristles 152 may be composed of many different materials such as plastics, nylon, or natural materials, including bamboo and pig whiskers to name a few. Regarding the design of the apparatus, adapting the massive engineering and manufacturing automation experience in making toothbrushes 46 would be helpful in integrating bristles 152 to be used in sample embodiments described herein.

Partial enlarged views in FIG. 66A, FIG. 66B, FIG. 66C and FIG. 66D show Blade and Bull Nose 28 profiles. FIG. 66A shows a partially enlarged view of both ends of the folded bent end Fabricated Bristle 220 with its ultimate bent end being formed to produce a Pull-Blade 26 type profile with Bull Nose 28-like profiles formed by the bends in the two ends. FIG. 66B shows a partially enlarged view of both ends of the folded Pull-Blade Fabricated Bristle 222 with Pull-Blade 26 and Bull Nose 28 profiles. FIG. 66C shows a partially enlarged view of both ends of the folded Push-Blade Fabricated Bristle 224 with Push-Blade 30 and Bull Nose 28 profiles. FIG. 66D shows a partially enlarged view of both ends of the folded Push-Pull Fabricate Bristle 226 with Push-Pull 32 Blade and Bull Nose 28 profiles. Fabricated Bristles 202 may have greater girth than those of a toothbrush 46 bristle 152 and differ from toothbrush 46 bristles 152 in that they may have Blade and Bull Nose 28 profiles as shown on FIG. 65 and FIG. 66.

FIG. 67 illustrates a folded Pull-Blade Fabricated Bristle 222 and FIG. 68 shows plurality of the folded Pull-Blade Fabricated Bristles 222, herein named a "folded Pull-Blade Fabricated Bristle grouping" 228. FIG. 68A shows a partially enlarged view of the folded Pull-Blade Fabricated Bristle grouping 228 ends with Bull Nose 28 and Pull-Blade 26 profiles.

Figure 69:
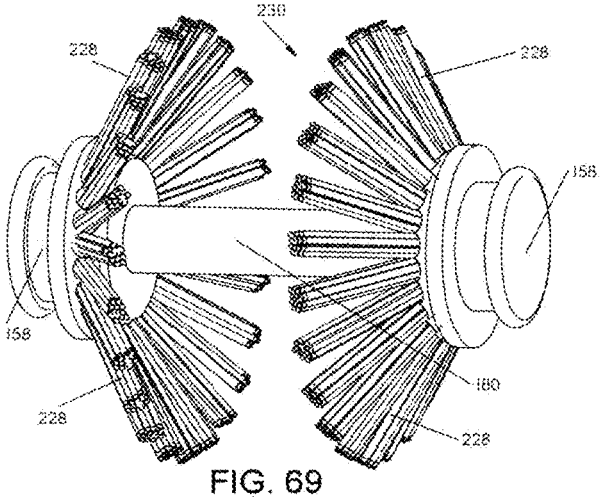
FIG. 69 depicts a view of an embodiment of the apparatus of the invention with fabricated folded bristles installed.

FIG. 69 shows a perspective view of an embodiment 230 with folded Pull-Blade Fabricated Bristle groupings 228 installed onto a pair of opposing Hubs 158 with their Pull-Blade Fabricated Bristle groupings 228 slanted inwards in the manner discussed in FIG. 54 and FIG. 54A. A bristle cross member 180 connects the Hubs 158 together. The embodiment 230 provides an illustration of one type of Fabricated Bristles 202 clustered together in groups to clear plaque 18. In use, as the folded Pull-Blade Fabricated Bristle groupings 228 engage teeth 48 and teeth 50 in an angled-in sprung manner. Upon contact, the Pull-Blade Fabricated Bristle groupings 228 fan out across the dental anatomy covering a broad area of teeth 48 and teeth 50 and gingivae pockets 16 during each cycle of chewing.

Figure 70:
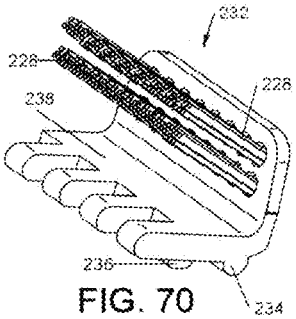
FIG. 70 depicts an "L" shaped part with a plurality of FIG. 68 fabricated bristle groups installed.

Relative to the discussions concerning FIG. 64 through FIG. 69, Fabricated Bristles 202 may provide a vast improvement in the manner in which plaque 18 may be reduced due to their push, pull and/or push-pull clearing capabilities FIG. 70 shows a First L-Fixture assembly 232 made up of a plurality of folded Pull-Blade Fabricated Bristle groupings 228 installed onto, herein named an "L Fixture" 238. The folded Pull-Blade Fabricated Bristle groupings 228 are installed into L Fixture holes 244 (shown in FIG. 72) in a manner similar to the bristle 152 installation procedure discussed in FIG. 54 and FIG. 54A. L Fixtures 238 are right-angle shaped parts that have hinge points 234, that serve as pivot for the L Fixture 238 during use, and angle stops 236 that provide a means to limit the extent of outer angular rotation of the L Fixtures 238 on the hinge points 234 when L Fixtures 238 are not being bitten on.

Figure 71:
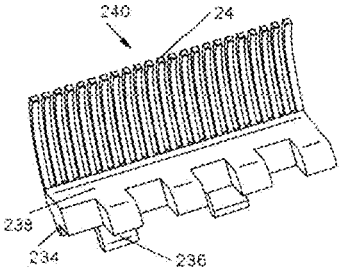
FIG. 71 depicts an "L" shaped part with a plurality of projections.
Figure 72:
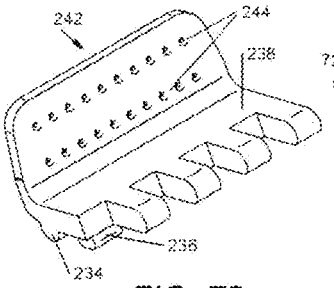
FIG. 72 depicts an "L" shaped part with a matrix of holes.
Figure 72A:
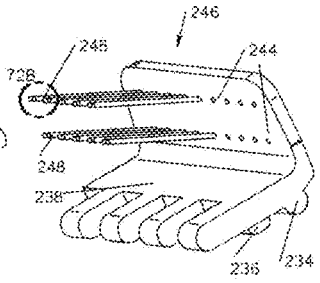
FIG. 72A depicts the FIG. 72 part with fabricated bristles installed in half of the matrix of holes.
Figure 72B:
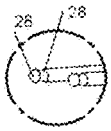
FIG. 72B depicts an enlarged partial view of the ends of the FIG. 72A fabricated bristles.

FIG. 71 shows a Second L Fixture assembly 240 that has a plurality of finger 24 protrusions across its width. FIG. 72 shows a Third L Fixture assembly 242 with an array of L Fixture holes 244 in the L Fixture 238. FIG. 72A shows a Fourth L Fixture assembly 246 with the L Fixture 238 having half of its array of L Fixture holes 244 empty and the other half with one-ended and broad in girth Fabricated Bristles 202 installed. FIG. 72B shows a partially enlarged view of the ends of the Fabricated Bristles 202 shown in FIG. 72A with Bull Nose 28 and Pull-Blade 26 profiles. FIG. 73, shows an embodiment 248 with four angled L Fixtures 238, fully populated with Fabricated Bristles 202 from FIG. 72A, exploded out following dashed lines away from angle stop cutouts 254 and hinge cutouts 256. All angle stop cutouts 254 and hinge 256 are shown as being cut into a Flat Arm 252. A hollow rebound tube 258 is exploded out following a dashed line from the Flat Arm 252.

FIG. 74 shows an assembled sample embodiment 248 and FIG. 75 shows embodiment 248 positioned between teeth 48 and teeth 50. The embodiment 248 may be initially positioned between the user's teeth 48 and teeth 50 with the user's teeth 48 and teeth 50 biting surfaces impacting the four L Fixtures 238. Prior to being bitten down on, The L Fixtures 238 are at a "home position", being pivoted out by the expansive pressure of the rebound tube 258 and restrained from further movement by the angle stops 236 positioned against the inner face of the angle stop cutouts 254 in flat Arm 252. As the user bites down onto the L Fixtures 238, the L Fixtures 238 pivot on the hinge points 234 rotating the Fabricated Bristle 202 ends inwards and onto the teeth 48 and teeth 50 surfaces. Biting resistance and the return to the home position can be provided by the elasticity of the hollow rebound tube 258. As the bite distance increases the Fabricated Bristles 202 ends slide along the teeth 48 and teeth 50 surfaces and into the gingivae pockets 16. As with prior embodiments, the angle and spring-like tension of the Fabricate Bristles 202 against the teeth 48 and teeth 50 surfaces allow the Blades to engage and reduce the extent of plaque 18 deposits all the way into the gingivae pockets 16. Given that embodiment 248's Fabricated Bristles 202 that have Pull-Blade profiles, the return to home position prompted by the expansion of the hollow rebound tube 258 causes the Blades to carve and diminish the plaque 18. The Pull-Blade 26 design pulls plaque 18 debris from the gingivae pockets 16 and the soft tissue may be protected by the Bull Nose profile 28. The hollow rebound tube 258 may be readily replaced with other types of Inserts already discussed to allow the embodiment 248 to dispense formulations onto the teeth 48 and teeth 50 surfaces and gingivae pockets 16 during use. Given that dental tools are generally made of metal, such as stainless steel, it may seem that metal would be ideal to remove plaque 18. Metal can be durable and holds an edge but may abrade tooth surfaces and damage gums given the chance for gouging.

FIG. 76 shows a simple part design, named herein a "Loop" 260. Loops 260 are made of a spring-like metal or other rigid materials and may be readily formed or extruded in lengths. The Loop 260 may be formed using an automatic wire-bending machine, or a similar equipment. FIG. 76A shows a partially enlarged view of one of the bent ends of the Loop 260. Given a reasonable concern about having sharp edges against soft tissue and dental enamel, the configuration of the Loop 260 eliminates this concern by having no protruding ends. Hence, the profile of the Loop 260's linear surface material pushes and pulls against plaque 18 deposits to reduce their mass without marring or injuring the user's anatomy. The profile of the extruded-like Loop 260 material may be that of any formable shape.

FIG. 77 shows a few possible profiles for Loop 260 fabrication along with the toothbrush bristle 152 width and the length of pencil lead 218 to provide a sense of the girth of the other Loop 260 profiles illustrated. In FIG. 77, four Loop 260 profiles are shown including a round Loop 262, a square Loop 264, a triangular Loop 266 and a multi-edged Loop 268. Partial enlarged views of the Loop 260 ends are shown as follows; FIG. 77A shows the round Loop 262, FIG. 77B shows the square Loop 264, FIG. 77C shows the triangular Loop 266 and FIG. 77D shows the multi-edged Loop 268. The round Loop 262 profile may be the least effective in clearing plaque 18 because corners or edges are needed to engage the plaque 18 mass. The square Loop 264 and the triangular Loop 266 profiles may provide the needed edges, but the multi-edged Loop 268 may offer a better overall shape for clearing plaque 18 deposits. This may be because the multi-edged Loop 268 has edges that essentially face in many directions allowing the Loop 260 to maintain an edge across the plaque 16 encrusted undulations of the teeth 48 and teeth 50 surfaces. Although the Loop 260 materials may be metal, the gauge of the metal Loop 260 may be quite thin, such as being just a bit larger than the girth of a toothbrush bristle 152. At this thickness, a metal Loop 260 may be quite flexible and readily adaptable to fit into facets of the teeth 48 and teeth 50 surfaces. In Loop 260 embodiments, as the Loop's bent ended protrusions are moved repeatedly by the user's chewing, the rounded ends of the Loop 260 projections engage the plaque 18 deposits and gradually diminish their mass.

FIG. 78 shows an exploded Loop sub-assembly 270 with the Loop 260 positioned to be installed into Loop slots 276 in a first half Rail 272 with an Arm guide 124 and then against a second half Rail 274. A dashed line shows the path for assembling the Loop 260 into the Loop slots 276 and sandwiched between the first and second Rail halves, 272 and 274. In manufacture, the three parts may be glued, bonded or by other means secured together to maintain the angled orientation of the Loop 260 against teeth 48 and teeth 50 surfaces.

Figure 79:
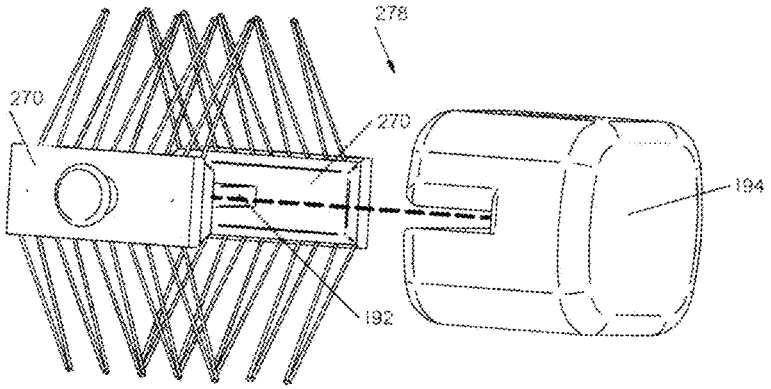
FIG. 79 depicts an embodiment of the apparatus of the invention made up of two FIG. 78 assemblies and a cross member with an insert positioned to be installed. The insertion path for the insert is shown by a dashed line.
Figure 80:
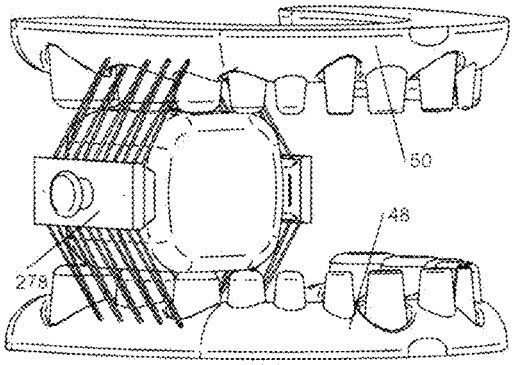
FIG. 80 depicts the FIG. 79 embodiment between the teeth in the upper and lower jaws.

FIG. 79 shows a sample embodiment 278 composed of a pair of Loop sub-assemblies 270 assembled and joined together by a half-pinned cross member 192. A small square Holed-Insert 194 is shown with a dashed line denoting a path of installation. FIG. 80 shows the embodiment 278 with the small square Holed-Insert 194 installed and the embodiment 278 positioned between the teeth 48 and teeth 50. The Holed Insert 194, shown in FIG. 79 and FIG. 80, could be a solid Insert made of a rubbery or foam-like material, possibly suitable to act as a sponge for the distribution of formulations. The Insert could also be a somewhat solid material with a chewy consistency, such as a gummy candy, licorice or other similar formulations.

Figure 81:
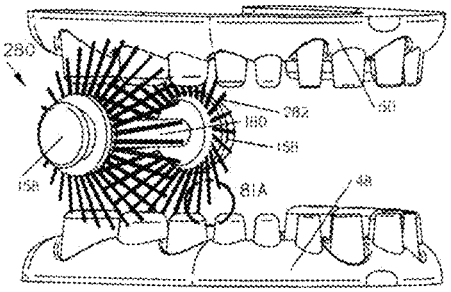
FIG. 81 depicts a sample round-like shaped embodiment similar to the FIG. 79 embodiment positioned between the teeth in upper and lower jaws.
Figure 81A:
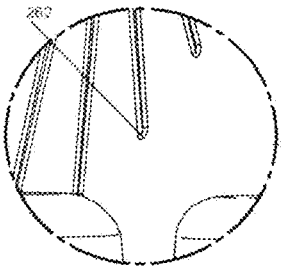
FIG. 81A depicts a partial enlarged view of the bent end of the FIG. 81 extruded protrusions.

FIG. 81 shows an embodiment 280, with a round Loop 282, positioned between Teeth 48 and teeth 50. FIG. 81A shows the bent end of the round Loop 282 end. The embodiment 280 can be assembled in a similar manner as the embodiment 278 without the small square Holed Insert 194. The round Loop 282, shown as installed into a Hub 158, may be split in half and then bonded or glued together with the round Loop 282 sandwiched between and positioned to maintain the angled orientation of the round Loop 282 against teeth 48 and teeth 50 surfaces. Two sets of round Loop 282 and Hub 158 assemblies are connected with a bristle cross member 180. Relative to the embodiment 280, if an Insert were to be installed it would need to be similar to the Slotted Insert 70 shown in FIG. 21 and FIG. 22. If the embodiment 280 had a screw together cross member, as shown in FIG. 23, an Insert like a Holed Insert 24 may be used. Any Insert installed may serve as the means to assist in restoring the embodiment 280 to its original unbitten position and dispensing formulations onto the teeth 48 and teeth 50 and into the gingivae pockets 16.

Figure 82:
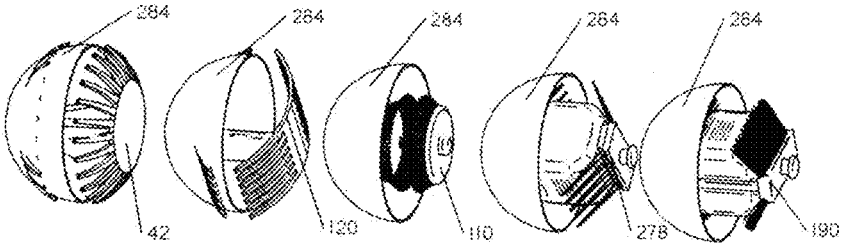
FIG. 82 depicts five sample embodiments from FIG. 8, FIG. 36, FIG. 34, FIG. 79, and FIG. 82 positioned within the center of halved orbs.

FIG. 82 shows the embodiments 42, 120, 110, 278 and 190 positioned at the center of five hollow orbs 284 cut in half. Taking the small size of the embodiments already shown into consideration, any of the embodiments shown may be viewed as the size of a large cherry.

Figure 83:
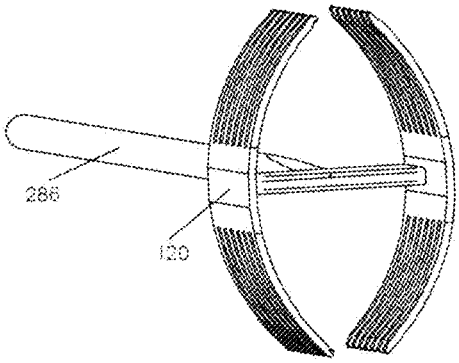
FIG. 83 depicts the FIG. 36 sample embodiment with an integrated stick.

FIG. 83 shows the embodiment 120 with a stick 286 integrated. The purpose of the stick 286 may be viewed as having the embodiment 120 to possibly function much like a lollypop.

Figure 84:
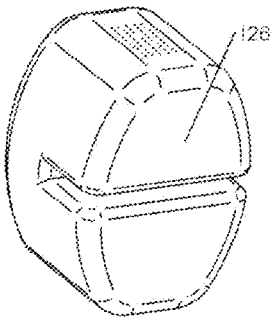
FIG. 84 depicts an insert with holes.
Figure 85:
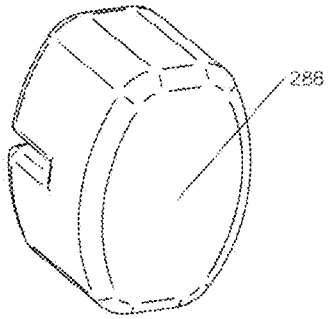
FIG. 85 depicts a solid insert.

FIG. 84 shows a square Holed-Insert 126 and FIG. 85 shows a same-sized Solid-Insert 288. Either Insert may provide a return bounce to the user's chewing. The square Holed-Insert 126 may dispense a formulation while the Solid-Insert 288 may be somewhat solid and made of a spongy material like a gummy. The Inserts may be laced with ingredients to help boost gingivae health and increase salivation to dispense plaque 18 debris.

Figure 86:
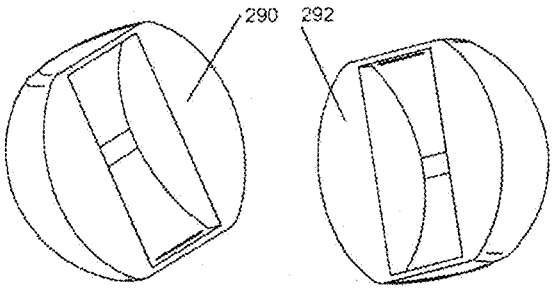
FIG. 86 depicts two half shell-like parts designed to encapsulate the FIG. 36 portion of the FIG. 83 embodiment.
Figure 87:
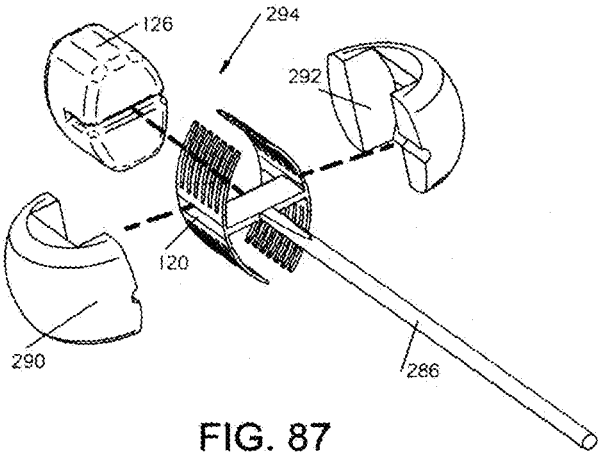
FIG. 87 depicts an exploded view of an embodiment of the apparatus of the invention made up of the FIG. 83 embodiment with dashed lines, showing installation paths.

FIG. 86 shows a first outer shell 290 and a second outer shell 292. FIG. 87 shows a view of embodiment 294 with embodiment 120 with the stick 286, the square Holed Insert 126, the first outer shell 290 and the second outer shell 292 exploded apart with dashed assembly lines.

Figure 88:
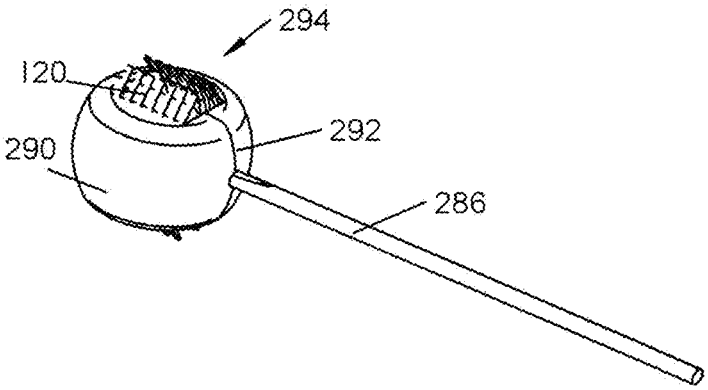
FIG. 88 depicts the FIG. 87 embodiment assembled.
Figure 89:
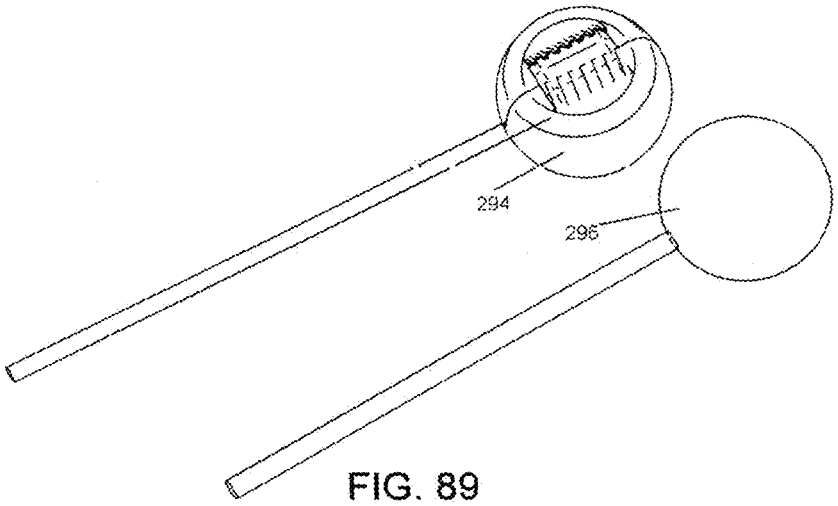
FIG. 89 depicts the FIG. 88 embodiment alongside a round candy lollypop as a size comparison.
Figure 90:
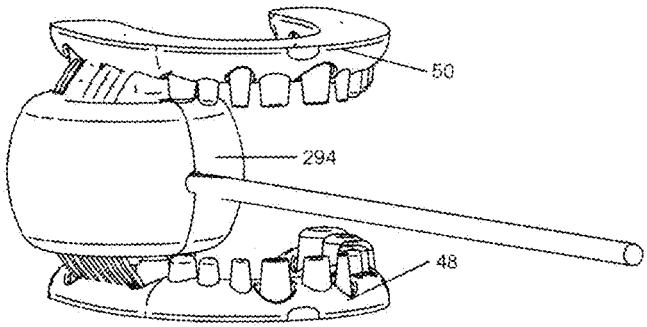
FIG. 90 depicts the FIG. 88 embodiment between the teeth in the upper and lower jaws.

FIG. 88 shows the embodiment 294 assembled and FIG. 89 shows embodiment 294 beside an image of a small round lollypop 296 image as a size comparison. FIG. 90 shows the embodiment 294 between the teeth 48 and teeth 50. The first outer shell 290 and the second outer shell 292 provides the means to encapsulate the embodiment 120 portion of the embodiment 294 leaving the leading ends of the upper and lower plurality of the embodiment 120's finger 24 protrusion ends exposed. To make this work, the flattened top and bottom of the first and second outer shells 290 and 292 provide a placement orientation when the user inserts the embodiment 294 between the teeth 48 and teeth 50. This ensures that the extent of the finger 24 protrusions exposed may be sufficient to allow the finger 24 protrusions to flex as the user first bites down onto the embodiment 294. If the first and second outer shells 290 and 292 were to be made of tasty ingredients and the square Holed Insert 126 was filled with a mouth-watering digestible formulation, the embodiment 294 may be, in many ways, like a lollypop. The idea of transforming the embodiment 294 into something like a lollypop may be seen as combining a treat while helping to reduce periodontal disease. This may be thought of as marrying the process of clearing away plaque 18 with an enjoyable experience The idea of inadvertently cleaning gingivae pockets 16 while chewing and sucking on a lollypop-like embodiment 294 may be attractive to many while driving, doing homework or watching TV.

In terms of the technology involved in the development and production of the apparatus, none of the embodiments would seem to be any more complex than a disposable razor. In this regard, the benefits of using the Apparatus as discussed would seem to be far greater than getting a close shave.

The foregoing description of the embodiments of the apparatus of the present invention has been presented for purposes of illustration and description only. It is not intended to be exhaustive or limiting to the forms described. Numerous modifications are possible in light of the above teachings. Some of those modifications have been discussed, and others will be understood by those skilled in the art. In various embodiments disclosed herein, a single component can be replaced by multiple components and multiple components can be replaced by a single component to perform a given function or functions. Except where such substitution would not be operative, such substitution is within the intended scope of the embodiments. The embodiments described were chosen in order to best illustrate the principles of various embodiments as are suited to particular uses contemplated. The scope of the apparatus of the invention is not limited to the examples set forth herein, but can be employed in any number of applications and equivalent devices by those of ordinary skill in the art. Rather it is hereby intended that the scope of the invention is defined by the claims appended hereto.

What is claimed is:

1. An apparatus for the interdiction of periodontal disease comprising:

a device configured with a plurality of finger protrusions to clear a plaque on a surface of a plurality of teeth in a user's mouth and clear said plaque from a plurality of gingivae pockets of said plurality of teeth in said user's mouth; said finger protrusions having rounded, blunt, leading ends to protect a soft gingivae tissue and blade ends positioned slightly away from said blunt leading ends to scrape and clear said plaque from said teeth and said gingivae pockets; said finger protrusions slanted inwards to have their said blunt leading ends and said blade ends interface with and pressed against said surface of said plurality of teeth and said gingivae pockets to clear said plaque from said surface of said plurality of teeth and said gingivae pockets; said device having an insert for containing a hygienic formulation to limit a bacterial growth and flush plaque debris out of said gingivae pockets to interdict a progression of said periodontal disease; said device having an arm attachment for insertion, movement and removal of said device from said user's mouth; wherein said device is placed between a plurality of upper teeth and a plurality of lower teeth within a user's mouth; wherein said device placed between said plurality of upper teeth and said plurality of lower teeth is chewed by a user; wherein when said device is chewed by said user, said finger protrusions bend inwards, caused by the biting down or closing of said plurality of upper teeth and said plurality of lower teeth onto said device; wherein said leading blunt ends and said blade ends of said finger protrusions slide against said surface of said plurality of upper teeth and said plurality of lower teeth to remove plaque deposits on said surface of said plurality of teeth; wherein said leading blunt ends and said blade ends of said finger protrusions enter said gingivae pockets to remove said plaque debris from said gingivae pockets; and wherein said finger protrusions spring back after removal of said plaque debris from said gingivae pockets to prevent damage to a soft tissue of said gingivae pockets; wherein the device has a shape with two halves, each half having a plurality of finger protrusions, and with the two halves joined at the center by a cross member structure; and wherein the entire device with the finger protrusions and inserts are composed of slow-dissolving digestible formulations that may be fully chewed and swallowed.

2. The apparatus as in claim 1 wherein, the finger protrusions are of varying sizes, shapes and lengths to accommodate individual user's needs as for example, a child's gingival profile being closer to biting surfaces than a senior with a receding gum line.

3. The apparatus as in claim 1 wherein, the blade ends of the finger protrusions are one of a pull blade configured to be pulled into and through plaque deposits, a push blade configured to slice into plaque deposits, and a push-pull blade configured to slice into plaque deposits by being pushed and pulled to reduce the mass of the plaque deposits on the teeth surface and gingivae pockets.

4. The apparatus as in claim 1 wherein, the device has a round yo-yo-like shape.

5. The apparatus as in claim 4 wherein, the device is the diameter of a U.S. quarter coin.

6. The apparatus as in claim 4 wherein, the device has a bulbous center that increases the biting pressure of the user when said bulbous center gets compressed while the user chews on the device which allows the finger protrusions to reach the gingivae pockets, and retreat after the blades disrupt and clear the plaque from the teeth surface and the gingivae pockets.

7. The apparatus as in claim 4 wherein, the device has an insert placed over the cross member structure between the two halves, with said insert releasing air when compressed between the teeth to provide bite resistance to allow the finger protrusions to extend to the gingivae pockets.

8. The apparatus as in claim 7 wherein, the insert has a plurality of holes through which air is released when the insert is compressed between the teeth to provide bite resistance to allow the finger protrusions to extend to the gingivae pockets, and allow for the disbursement of hygienic formulations contained within the insert, to clear the plaque debris from the gingivae pockets.

9. The apparatus as in claim 7 wherein, the insert is designed as a disposable cartridge containing digestible formulations for oral hygiene, bacterial inhibition and to promote salivation for removing plaque debris from the gingivae pockets.

10. The apparatus as in claim 1 wherein, the device is bottle-shaped with a screw on cap, a tire-shaped insert with flow holes and a rotatable arm, with the insert capable of being refilled with a digestible formulation of choice by the user.

11. The apparatus as in claim 10 wherein, the tire-shaped insert is made of a highly absorbent sponge-like material providing an option to soak the device in a digestible formulation for dissemination during later use of the device.

12. The apparatus as in claim 1 wherein, the device of the apparatus is square-shaped with a plurality of the finger protrusions oriented both upwards and downwards on both sides of the device with a half-width cross member joining the two sides of the device, and a square insert with holes designed to be installed and de-installed by slipping the insert on and off the half-width cross member.

13. The apparatus of claim 1 wherein, the device has a flat central cross member, two tooth pads, two center springs and two tethers with the finger protrusions having a spring base configuration which allows them to adjust their length as they come in contact with varying depths of the gingivae pockets and upon contact with the gingivae pockets, the finger protrusions spring back to protect the soft gingivae tissue from injury.

14. The apparatus of claim 13 wherein, the center springs and tethers are replaced by a long-holed insert permanently installed.

15. The apparatus as in claim 1 wherein, the device has a lever arm, a flattened cross member and a plurality of finger protrusions emanating from the top and bottom of the said flattened cross member.

16. The apparatus as in claim 1 wherein, the device is comprised of two hub assemblies having toothbrush type bristles joined together by a cross member, holed insert and rotatable arm.

17. The apparatus as in claim 1 wherein, the device is comprised of a set of four L-shaped fixtures having a plurality of folded pull-blade fabricated bristles, with the L-shaped fixtures pivoting on hinges and rotating the said pull-blade fabricated bristle ends inwards onto the upper and lower plurality of teeth and the gingivae pockets.

18. The apparatus as in claim 1 wherein, the device is shaped like a lollipop with the finger protrusions and an insert placed between two outer shells.

* * * * *